US006522254B1

(12) United States Patent
Yamano

(10) Patent No.: US 6,522,254 B1
(45) Date of Patent: Feb. 18, 2003

(54) SMOKE DETECTOR, AND INSECT SCREEN

(75) Inventor: Naoto Yamano, Tokyo (JP)

(73) Assignee: Hochiki Corporation, Tokyo (JP)

( * ) Notice: Subject to any disclaimer, the term of this patent is extended or adjusted under 35 U.S.C. 154(b) by 0 days.

(21) Appl. No.: 09/699,412

(22) Filed: Oct. 31, 2000

(30) Foreign Application Priority Data

Nov. 1, 1999 (JP) ..... 11-310591

(51) Int. Cl.[7] ..... G08B 17/10

(52) U.S. Cl. ..... 340/630; 340/628; 340/629; 340/693.5; 250/574

(58) Field of Search ..... 340/628, 629, 340/630; 250/574, 693.5

(56) References Cited

U.S. PATENT DOCUMENTS

| | | | | |
|---|---|---|---|---|
| 4,124,298 A | | 11/1978 | Steele | 356/338 |
| 4,206,366 A | | 6/1980 | Marsocci et al. | 250/574 |
| 4,439,683 A | * | 3/1984 | Dobrzanski | 250/381 |
| 4,851,819 A | * | 7/1989 | Kawai et al. | 340/630 |
| 5,399,864 A | * | 3/1995 | Igarashi et al. | 250/381 |
| 6,057,774 A | * | 2/2000 | Venzant | 340/628 |
| 6,195,014 B1 | * | 2/2001 | Sakuri et al. | 340/630 |

FOREIGN PATENT DOCUMENTS

| | | | |
|---|---|---|---|
| GB | 2 277 376 A | 10/1994 | G08B/17/107 |
| JP | 2270803 A | 11/1990 | A01N/53/02 |
| JP | 5-78879 | 10/1993 | G08B/17/107 |
| JP | 10241073 A | 9/1998 | G08B/17/107 |
| JP | 11016064 A | 1/1999 | G08B/17/103 |

* cited by examiner

*Primary Examiner*—Daniel J. Wu
(74) *Attorney, Agent, or Firm*—Sughrue Mion, PLLC

(57) ABSTRACT

A smoke detector is provided with a light emission section holder having a light-emission element and a light receiving section holder having a light-receiving element. The light emission section holder and the light-receiving element are provided in a smoke detection section constituting a smoke detection space. The light emitted from the light-emission element is scattered by smoke entered the smoke detection space. The thus-scattered light is received by the light-receiving element,thereby detecting occurrence of fire. An insect screen is formed from soft fiber having a mesh pattern and is arranged so as to cover the entirety of the smoke detection section.

12 Claims, 18 Drawing Sheets

SMOKE DETECTOR, AND INSECT SCREEN

BACKGROUND OF THE INVENTION

1. Field of the Invention

The present invention relates to a smoke detector equipped with an insect screen for preventing entry of insects into a smoke detecting space, as well as to an insect screen.

2. Description of the Related Art

FIGS. 19 to 22 show a commonly employed photoelectric smoke detector. FIG. 19 is a longitudinal cross-sectional view of the smoke detector; FIG. 20 is a transverse cross-sectional view of the smoke detector; FIG. 21 is a layout and construction drawing of a smoke detecting section; and FIG. 22 is a disassembly view of the smoke detector.

As shown in FIGS. 19 and 20, a terminal board 203 is housed in an exterior cover 201, and a shield case 204 is fixedly attached to the interior of the terminal board 203. A smoke detecting section main body 205 is fitted to the terminal board 203, and a printed board 208 is provided on the smoke detecting section main body 205. A plurality of smoke inlets 202 are formed along the circumference of the exterior cover 201.

A smoke detecting section cover 211 is removably attached to the lower surface of the smoke detecting section main body 205. Smoke inlets 215 are formed in the circumferential wall of the smoke detecting section cover 211. A plurality of labyrinthine members 213 are formed inside the circumferential wall. An insect screen 214 is integrally provided on the smoke detecting section 211.

A light-emission element 221, such as an infrared LED or the like, is housed in a light-emission holder 217 provided on the lower surface of the smoke detecting section main body 205. A light-receiving holder 216 houses a light-receiving element 220, such as a photodiode PD or the like. As can be seen from FIG. 21, the optical axis of the light-emission element 221 and the optical axis of the light-receiving element 220 are arranged so as to cross each other in the center of a smoke detecting space and at an angle of, for example, 70°. Here, reference numeral 228 designates an infrared LED for test purpose, and 232 designates a plate member having a slit formed therein.

As shown in FIG. 22, the above-described smoke detector is built by means of assembling together the terminal board 203 having fitting hardware 209 fixed thereon; the shield case 204; packing 207, the printed board 208; the smoke detecting section main body 205; the smoke detecting section cover 211; and the exterior cover 201.

In many cases, the insect screen 214 used in a commonly employed smoke detector is made of metal. As shown in FIG. 22, the insect screen 214 is provided so as to cover the smoke detecting section cover 211 constituting the labyrinthine elements of the smoke detecting section. In order to attain an improvement in ease of production and the strength of a smoke detector, an insect screen is integrally formed with a smoke detecting section during a molding operation (see Japanese Patent Publication No. Hei 5-78879).

Such an insect screen used with the smoke detector is formed by means of rolling a flat metal plate into a ring shape, hexagonal holes being formed in the metal plate, and attaching the thus-rolled metal plate to a position around labyrinthine elements of a smoke detecting section or integrally embedding the metal plate into the smoke detecting section during a molding operation. Thus, production of the smoke detector becomes complicated.

In the case of a smoke detector in which an insect screen is integrally formed with labyrinthine elements of a smoke detecting section, the insect screen cannot be replaced after production, even when replacement is desired. In such a case, a smoke detecting cover constituting labyrinthine elements or a smoke detecting section main body must be replaced inconveniently. Another problem of the smoke screen is that insects which favor narrow areas sometime intrude holes of the insect screen.

SUMMARY OF THE INVENTION

The present invention has been conceived in light of such drawbacks of the commonly used smoke detector, and it is an object of the present invention to provide a smoke detector which is easy to build and is provided with a low-cost insect screen, as well as an insect screen for use with the smoke detector.

The present invention provides a smoke detector which includes a smoke detecting section defining a smoke detecting space and detects occurrence of fire by detection of smoke flowing into the smoke detection space, the sensor comprising:

an insect screen which is formed from a soft material of mesh structure and is arranged around the smoke detecting section.

The smoke detecting section is open toward the periphery and the bottom, and the insect screen is arranged so as to fully cover the periphery of the smoke detecting section and the open bottom of the smoke detecting section. The insect screen is made from permeable fabric woven from soft metal fiber or chemical fiber. Alternatively, fiber impregnated with a repellent is used as the insect screen. The insect screen is fixedly sandwiched between an interior circumferential edge of an exterior cover and an exterior circumferential edge of a smoke detecting main body.

Thus, permeable cloth woven from fiber is used as the insect screen. In contrast with a commonly employed insect screen made by means of etching a metal plate, the fabric insect screen has a higher airflow permeability. In a case where a repellent is applied to an insect screen, since the insect screen is made of fabric, the fiber is sufficiently impregnated with a repellent, thus exhibiting an insect-proofing effect over a long period of time. Even when meshes are slightly wide, the insect-proofing effect prevents intrusion of insects. and does not have any special fixing structure. Hence, the insect screen can be readily removed by means of removal of only the exterior cover. Thus, easy removal and replacement of an insect screen is implemented.

The present invention also provides an insect screen for preventing intrusion of insects into a smoke detecting space of a smoke detector. The insect screen is characterized by being made of permeable fabric woven from metal or chemical fiber. As mentioned above, so long as permeable cloth woven from fiber is used as an insect screen, a higher airflow permeability can be attained as compared with a case where a commonly employed insect screen is made from a metal plate through etching. So long as a repellent is applied to fiber, the fiber is sufficiently impregnated with a repellent. Thus, an insect-proofing effect can be exhibited over a long period of time. Further, even in a case where meshes are slightly wide, the insect-proofing effect an be exhibited over a long period of time. Further, even in a case where meshes are slightly wide, the insect-proofing effect prevents intrusion of insects into the insect screen.

PREFERRED EMBODIMENTS OF THE INVENTION

Preferred embodiments according to the present invention will be described as follows referring to the accompanying drawings.

Figure 1:
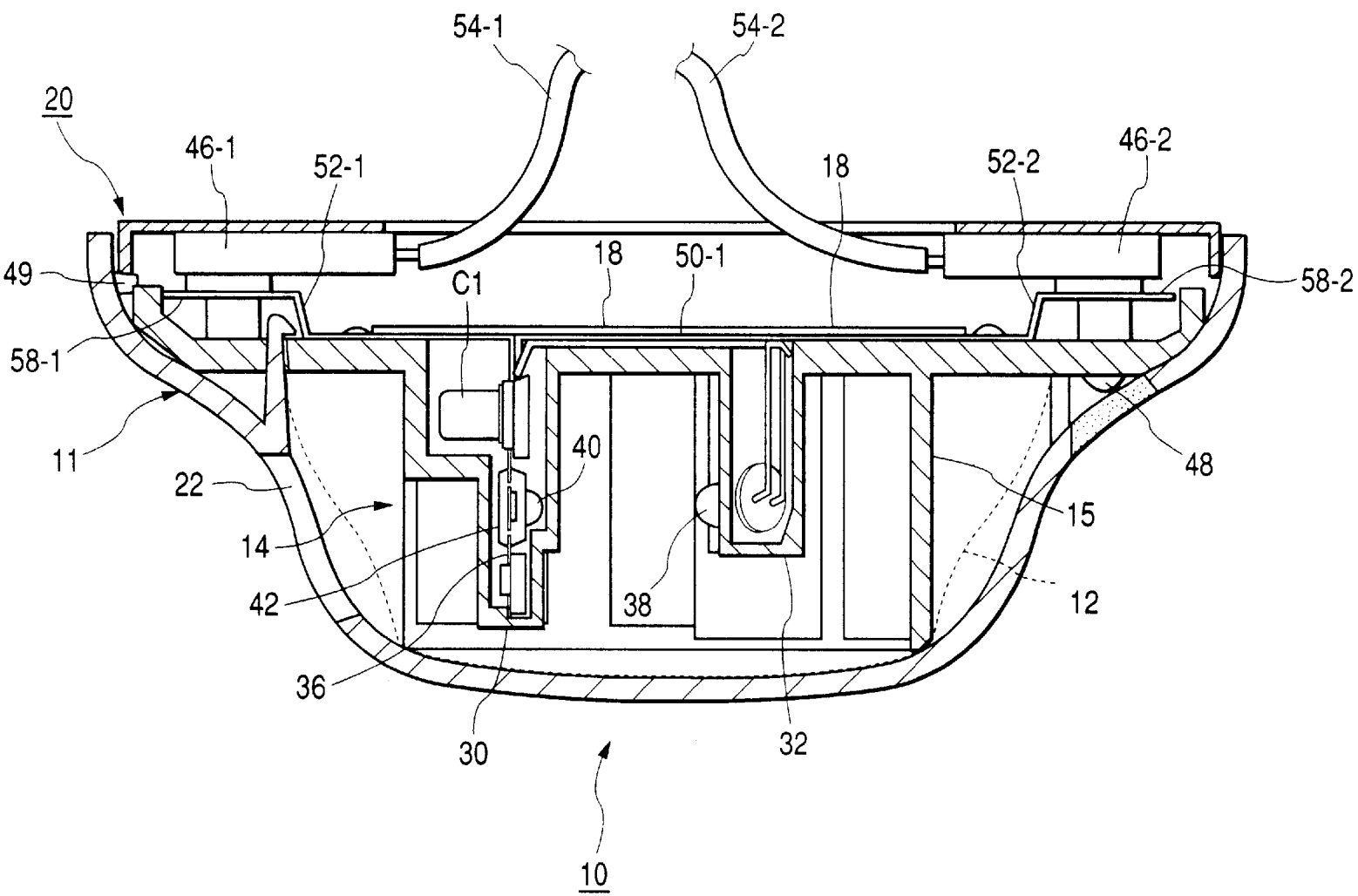
FIG. 1 is a cross-sectional view showing a smoke detector according to the present invention.

As shown in FIG. 1, a photoelectric smoke detector 10 according to the present invention comprises an exterior cover 11 and a smoke detecting section 14. An insect screen 12 is provided inside the exterior cover 11 and is sandwiched between the exterior cover 11 and the smoke detecting section 14. A faceplate seal 18 is affixed on the upper surface of the smoke detecting section 14. The photoelectric smoke detector 10 is forcefully fitted around a mount base 20 fixedly screwed to the ceiling. Fitting projections 49 provided on the interior of the exterior cover 11 are fitted with fitting pieces provided on the mount base 20, wherewith the photoelectric smoke detector 10 is fixedly supported by the mount base 20.

A plurality of smoke inlet windows 22 are formed along the circumferential surface of the exterior cover 11 of the photoelectric smoke detector 10. The smoke detecting section 14 built into the inside of the exterior cover 11 constitutes a smoke detecting chamber underneath the bottom of a smoke detecting main body 15 such that the smoke detecting chamber has an opening. A light receiving section holder 30 and a light emission section holder 32 are provided within the smoke detecting chamber.

A light-emission element 38 using an infrared LED is built in the light emission section holder 32. A hybrid circuit board 36 is built into the light receiving section holder 30. An integrated circuit 42 integrally equipped with a light receiving section 40 is mounted on the hybrid circuit board 36.

On the hybrid circuit board 36, there are mounted, as discrete chip components, a capacitor C1 for supplying an electric current required for causing the light-emission element 38 to emit pulse light, and electric circuit components which are not incorporated in the integrated circuit 42.

A pair of pieces of lead hardware 52-1 and 52-2 are provided on the reverse side of the smoke detecting main body 15, and base contact sections 58-1 and 58-2 are formed along the outer circumferential edge of the smoke detecting section main body 15. The base contact sections 58-1 and 58-2 come into electrical contact with corresponding terminal blocks 46-1 and 46-2 provided on the mount base 20.

Lead wires 54-1 and 54-2 are pulled out from the reverse side of the ceiling by way of a wire through hole formed in the center of the mount base 20, and the thus-pulled lead wires 54-1 and 54-2 are inserted into and connected to the corresponding terminal blocks 46-1 and 46-2.

Figure 2:
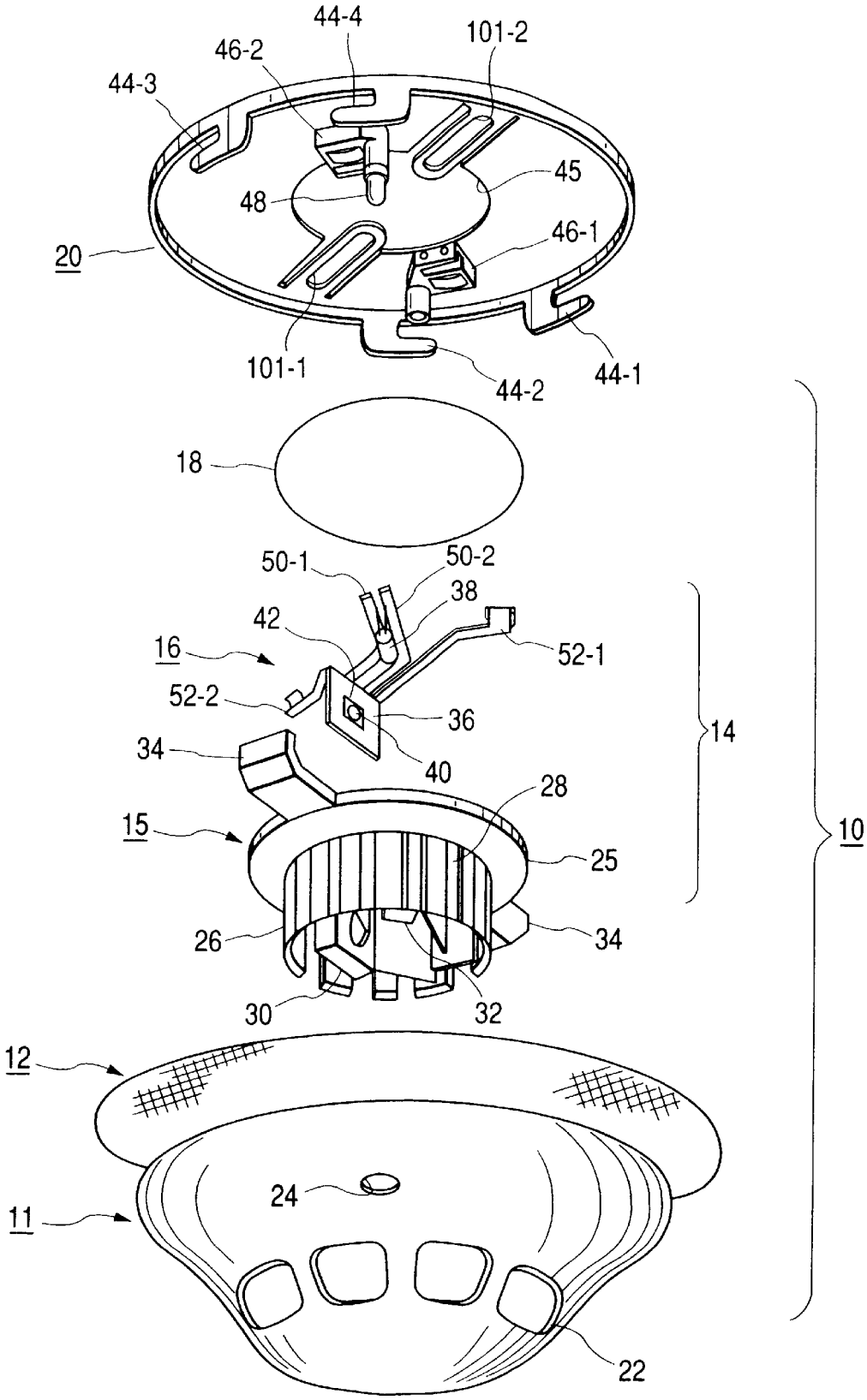
FIG. 2 is an exploded view of the smoke detector according to the present invention.

FIG. 2 shows an exploded view of the photoelectric smoke detector according to the present invention shown in FIG. 1, along with the mount base 20.

As shown in FIG. 2, the photoelectric smoke detector 10 according to the present invention comprises, in sequence from below, the exterior cover 11, the insect screen 12, the smoke detecting main body 15, a smoke-detection-section assembly 16 provided with a hybrid circuit board 36, and the faceplate seal 18. As shown in FIG. 1, the photoelectric smoke detector 10 is fittingly secured to the mount base 20.

Smoke inlet windows 22 are formed in a lower portion of the outer periphery of the exterior cover 11. An indication hole 24 is formed in the exterior cover 11, and the tip end of a disaster warning indicating lamp 48 is provided on the mount base 20.

The indication hole 24 doubles as a drip hole for discharging any water leaking from the ceiling, to thereby prevent formation of a puddle of water within the smoke detector 10.

The insect screen 12 is continuously attached to the exterior cover 11. For instance, canvas made of meshed fabric is used as the insect screen 12. When the smoke detecting main body 15 and the exterior cover 11 are assembled together, the insect screen 12 is sandwiched therebetween. As shown in FIG. 1, the insect screen 12 is sandwiched between the exterior cover 11 and the smoke detecting section main body 15 and is interposed between the smoke inlet holes 22 and an interior smoke detecting space.

The smoke detecting section 14 is made up of the smoke detecting section main body 15 and the smoke-detection-section assembly 16. The smoke detecting section main body 15 is made up of an upper disk-shaped base 25, and a peripheral wall 26 having openings 28 formed therein is provided on the underside of the base 25. A labyrinthine structure is formed within the peripheral wall 26. The light receiving section holder 30 and the light emission section holder 32 are provided within the interior smoke detecting space.

Figure 11:
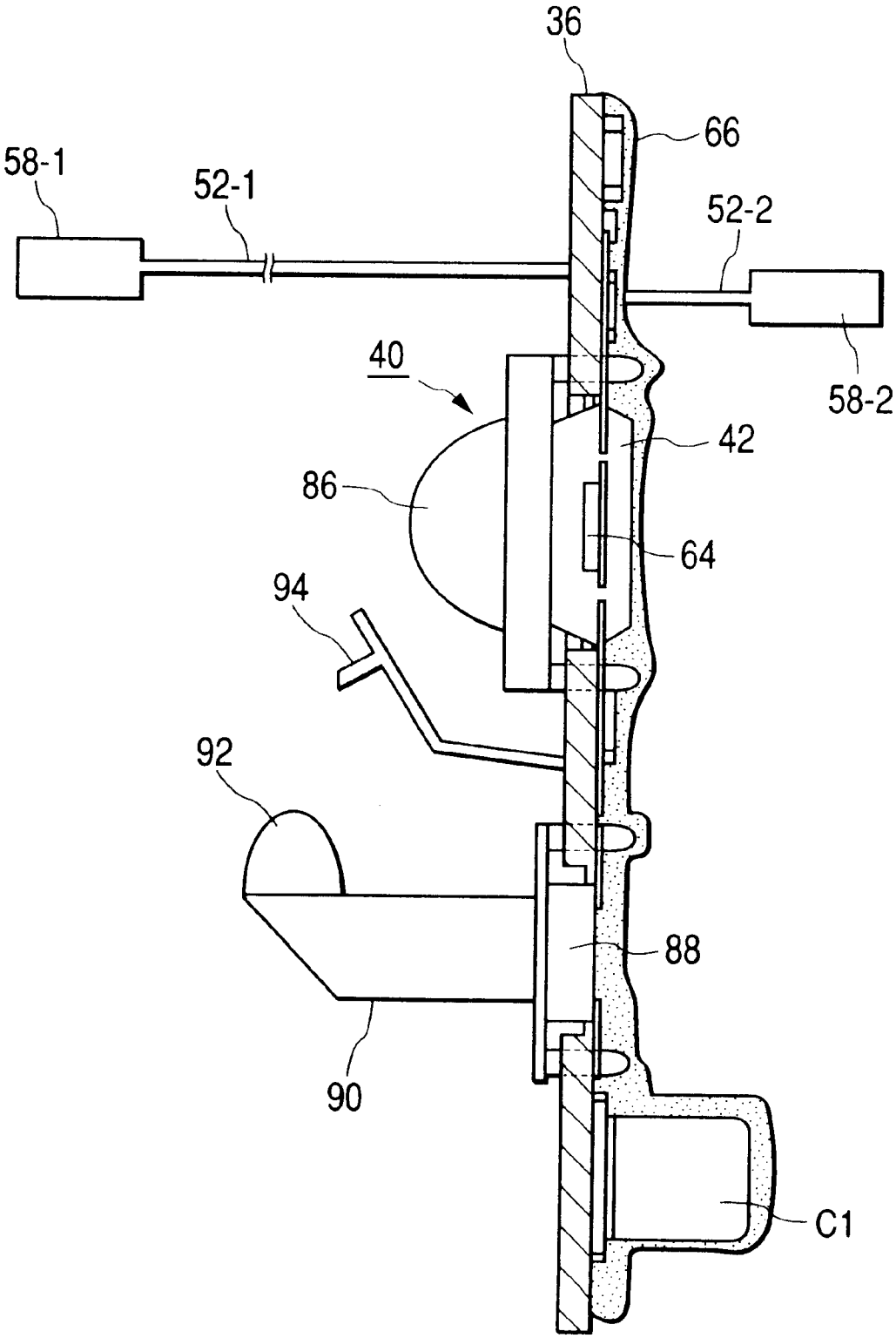
FIG. 11 is a cross-sectional descriptive view showing another embodiment of the hybrid circuit board, in which a light emission section is mounted on the circuit board.

A pair of assembly arms 34 project from respective sides of the base 25. The smoke detecting section main body 15 is characterized in that the peripheral wall 26 has no bottom and is opened toward the exterior cover 11. Because of such a structure, in a case where smoke enters the smoke detector 10 by way of the smoke inlet windows 22 while the smoke detecting section main body 15 is assembled in the exterior cover 11 as shown in FIG. 11, the smoke flows into the interior smoke detecting space by way of the openings 28 formed in the peripheral wall 26. Simultaneously, smoke flows into the smoke detecting space by way of the open bottom of the peripheral wall 26. Thus, there can be attained superior smoke inflow efficiency and inflow directivity.

The smoke-detection-section assembly 16 comprises a pair of pieces of lead hardware (first lead hardware) 50-1 and 50-2 for connecting the light-emission element 38 to the hybrid circuit board 36, and a pair of pieces of lead hardware (second lead hardware) 52-1 and 52-2 to be brought into contact with the mount base 20.

An integrated circuit 42 is mounted on the hybrid circuit board 36, and a light-receiving element is integrally provided in the integrated circuit 42. For this reason, the hybrid circuit board 36 is equipped with the light receiving section 40 having a lens. The smoke-detection-section assembly 16 is built into the smoke detecting section main body 15 from above while remaining in an assembled state shown in the drawing. As a result, the integrated circuit 42 is situated in the center of the light receiving section holder 30. Moreover, the light-emission element 38 is situated within the light emission section holder 32, thus embodying a smoke detecting structure of scattered-light type.

The faceplate seal 18 is placed on the smoke detecting section 14 so as to block an open hole formed in the smoke detecting section main body 15 for accommodating the smoke detecting section 14, after the smoke-detection-section assembly 16 has been built into the smoke detecting section main body 15 from above.

The photoelectric smoke detector 10 according to the present invention can be completed by means of assembly of five parts; that is, the exterior cover 11, the insect screen 12, the smoke detecting section main body 15, the smoke-detection-section assembly 16 having the hybrid circuit board 36, and the faceplate seal 18.

Figure 22:
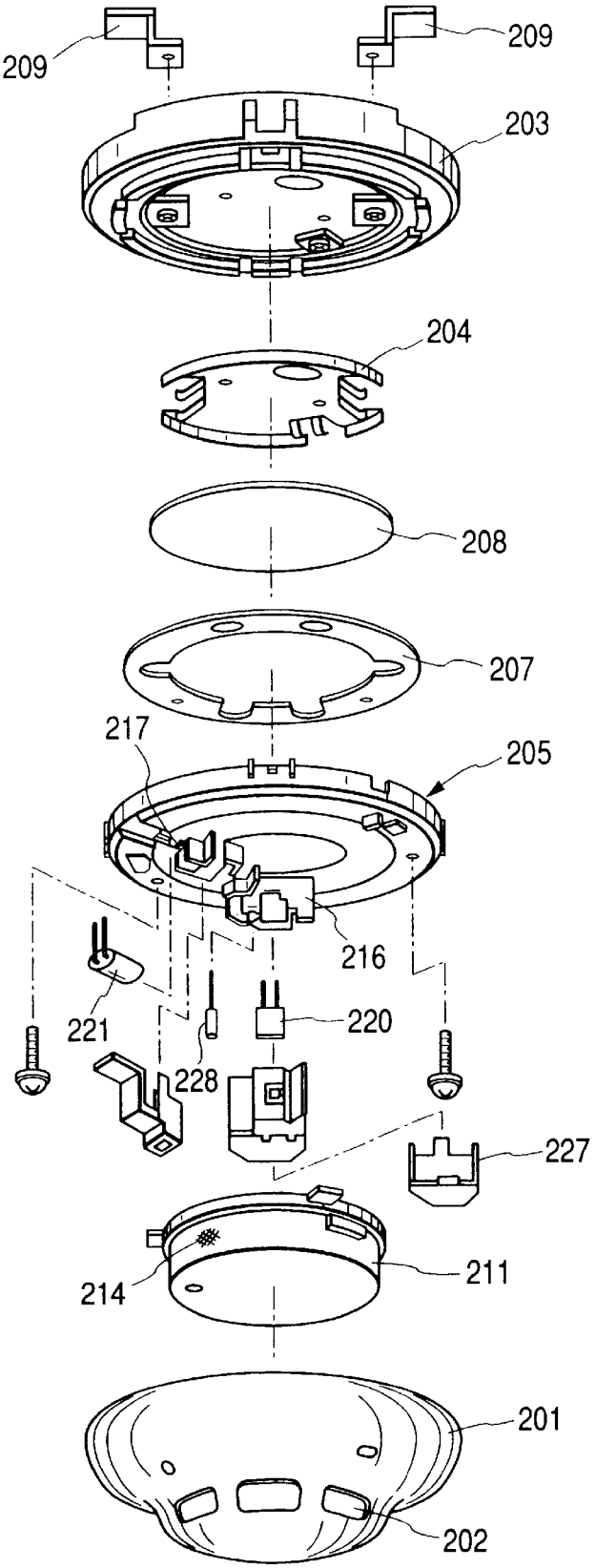
FIG. 22 is an exploded view of the commonly-employed photoelectric smoke detector shown in FIG. 19.

In the case of the commonly-employed photoelectric smoke detector shown in FIG. 22, seven parts ranging from the exterior cover 201 to the terminal board 203, in sequence from below, are required. In the smoke detecting section main body 205, the light-receiving element 220 is housed in the light receiving section holder 216, and the light-emission element 221 is built into a light-emission holder 217. Thus, the commonly-employed photoelectric smoke detector involves assembly of a plurality of parts. In contrast with the commonly-employed photoelectric smoke detector, the smoke detector according to the present invention requires only a single smoke-detection-section assembly 16.

Consequently, in contrast with the commonly-employed smoke detector, the photoelectric smoke detector according to the present invention enables a considerable reduction in the number of parts to be assembled, facilitated assembly of parts, corresponding cost reduction, and a reduction in profile and size of the smoke detector.

The mount base 20, by way of which the photoelectric smoke detector is assembled from the five parts, is attached to the ceiling. Four fitting pieces 44-1, 44-2, 44-3, and 44-4 are formed at respective positions along the circumference of the mount base 20. A wire through hole 45 is formed in the center of the mount base 20, and mount screw through holes 101-1 and 101-2 are formed at respective positions and extend toward the wire through hole 45.

The fitting projections 49 provided inside the exterior cover 11 shown in FIG. 1 are fitted into corresponding fitting pieces 44-1 to 44-4 of the mount base 20, thus fixedly supporting the photoelectric sensor 10.

Since the mount base 20 has such a low-profile structure, the mount base 20 can be readily formed by means of punching sheet metal. Terminal blocks 46-1 and 46-2 are attached on the mount base 20 so as to face downward, and the disaster warning indicating lamp 48 is attached on the terminal block 46-2.

When the photoelectric smoke detector 10 shown in FIG. 1 is mounted on the ceiling, the mount base 20 is retracted into the exterior cover 11 and is prevented from becoming exposed. Therefore, there can be obviated a necessity of forming the mount base 20 from synthetic resin, as is the exterior cover 11 of the sensor 10, or a necessity of coating the mount base 20 for enhancing the appearance of the smoke detector 10, which is required of a commonly-employed photoelectric smoke detector. The only requirement is that the mount base 20 formed from sheet metal be imparted with corrosion resistance; namely, rust proofing. Therefore, costs of the mount base 20 are reduced correspondingly.

Since the mount base 20 is very thin, the degree of projection of the photoelectric smoke detector 10 when the sensor is mounted on the ceiling can be sufficiently reduced. A sensor circuit is integrated, and the thus-integrated sensor circuit is mounted on the hybrid circuit board 36. The hybrid circuit board 36 is housed in the light receiving section holder 30 of the smoke detecting section main body 15. As a result, the photoelectric smoke detector 10 obviates the necessity for a space for housing a circuit board which has hitherto been formed in a position above the smoke detecting section 14.

As mentioned above, a necessity for forming the circuit board housing section in a position above the smoke detecting section is obviated. Accordingly, the height of the smoke detector is considerably reduced, thus embodying a compact and low-profile sensor structure. Combined with the thin mount base 20, the compact and low-profile sensor structure enables a significant reduction in the degree to which the smoke detector 10 protrudes from the ceiling, as compared with the case of the commonly-employed smoke detector.

Figure 3A:
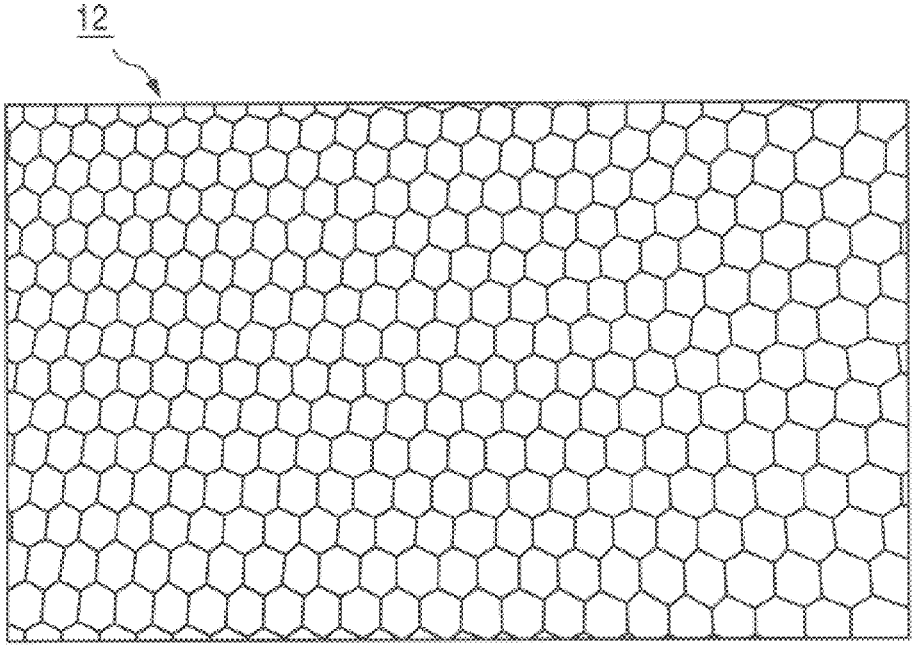
FIGS. 3A and 3B are enlarged descriptive views of the insect screen shown in FIG. 2.
Figure 3B:
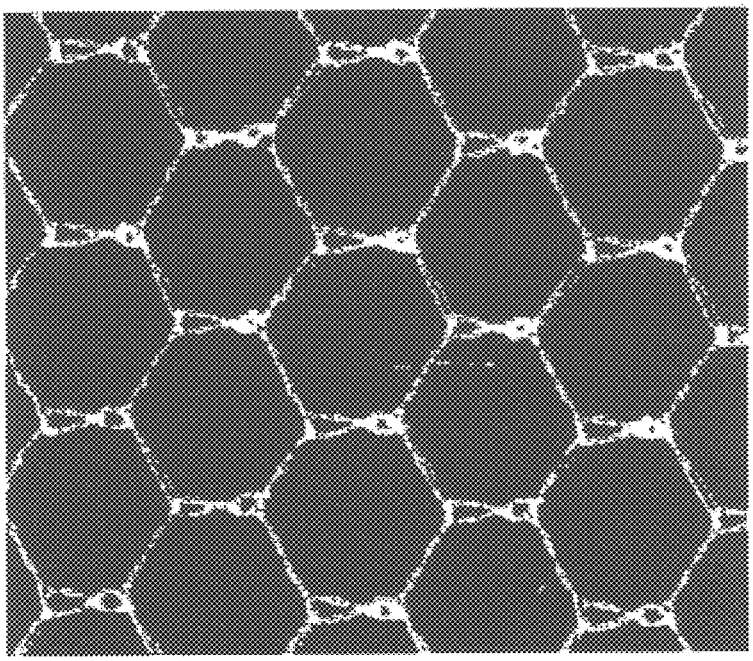

FIG. 3A is an enlarged view of a mesh structure of the insect screen 12 shown in FIGS. 1 and 2. FIG. 3B is a further-enlarged view of a mesh structure. The insect screen 12 is formed from a material, so-called "tulle", which is used for ground fabric of embroidery, a wedding veil and the like. The material is woven into a hexagonal mesh pattern from a plurality of strings of chemical fiber yarn; for example, nylon fiber.

The insect screen 12 made from tulle is thin, lightweight, flexible, and tensile. Further, as shown in FIGS. 3A and 3B, the insect screen 12 has a substantially-uniform mesh pattern. Even in a case where a metal screen made by means of etching a metal plate has the same number of meshes (apertures) per inch as those of the insect screen 12 made of fiber, the insect screen 12 of fiber can assume a greater void ratio than can the metal screen. Hence, the permeability of the insect screen 12 can be improved, thereby improving a smoke inflow characteristic of the smoke detector.

Since the insect screen 12 is woven into a hexagonal mesh pattern, the insect screen 12 has a retaining characteristic of high level. The insect screen 12 woven into a hexagonal mesh pattern is less susceptible to loosening than is a plainly-woven square mesh pattern and is superior to the square mesh pattern in terms of ease of processing. Although plainly woven, the insect screen 12 has the same function as that of a tulle organdie used as ground fabric of embroidery can also be used as material of the insect screen 12.

In addition to nylon, chemical fiber made of, e.g., polyester, acrylic, and rayon or metallic fiber made of, e.g., copper, aluminum, or iron, can also be used as fiber for weaving a tulle or organdie.

Any material can be used as the material of the insect screen 12, so long as the material is woven from metallic fiber or chemical fiber, has permeability, is thin, lightweight, and flexible, and has a uniform mesh pattern. In consideration of a smoke inflow characteristic and difficulty of insect intrusion, the insect screen 12 desirably has 20 to 50 meshes per inch.

Fiber impregnated with a repellent can be used as the insect screen 12. In a case where an insect screen is woven from fiber, an insect proofing effect can be maintained over a long period of time so long as the fiber has been immersed in a repellent beforehand. Fiber can be impregnated with a repellent beforehand according to one of the following methods; that is, a method of coating fiber with a repellent, a method of immersing fiber in a repellent, and a method of forming fiber by means of mixing repellent into raw materials of fiber.

By means of the insect proofing effect of an insect screen impregnated with a repellent, holes of the insect screen can be set larger than holes of a commonly-employed insect screen. Even if holes are made larger, intrusion of insects can be prevented. Therefore, the void ratio can be increased, thereby improving the airflow permeability of the insect screen.

Phenothorin or permetrin, which is a pyrethroid-based chemical commonly used as a repellent and exhibits a higher residual effect, can be used as a repellent. Incidentally, an insecticide can be used as the repellent in the present invention.

As shown in FIG. 2, the insect screen 12 formed from the above-described materials is interposed between the exterior cover 11 and the smoke detecting section main body 15 when the exterior cover 11 and the smoke detecting section main body 15 are assembled. As shown in FIG. 1, the insect screen 12 is fixedly sandwiched between the interior circumferential edge of the exterior cover 11 and the exterior circumferential edge of the smoke detecting section main body 15.

The smoke detecting section 14 is open toward the periphery and the bottom side, and the insect screen 12 is placed so as to fully cover openings formed in the peripheral direction and the open bottom of the smoke detecting section 14.

In a case where the insect screen 12 is woven from metal fiber, the insect screen 12 is positioned so as to fully cover openings formed to the periphery and the open bottom of the smoke detecting section 14. Therefore, the insect screen 12 can exhibit a shielding effect, thereby greatly alleviating influence of noise, which would otherwise be imposed on a circuit board.

The insect screen 12 does not have any special fixing structure and is fixedly sandwiched only between the interior circumferential edge of the exterior cover 11 and the exterior circumferential edge of the smoke detecting section main body 15. The insect screen 12 can be easily removed by means of removal of the exterior cover 11. Thus, the insect screen 12 can be easily removed and replaced.

Figure 4:
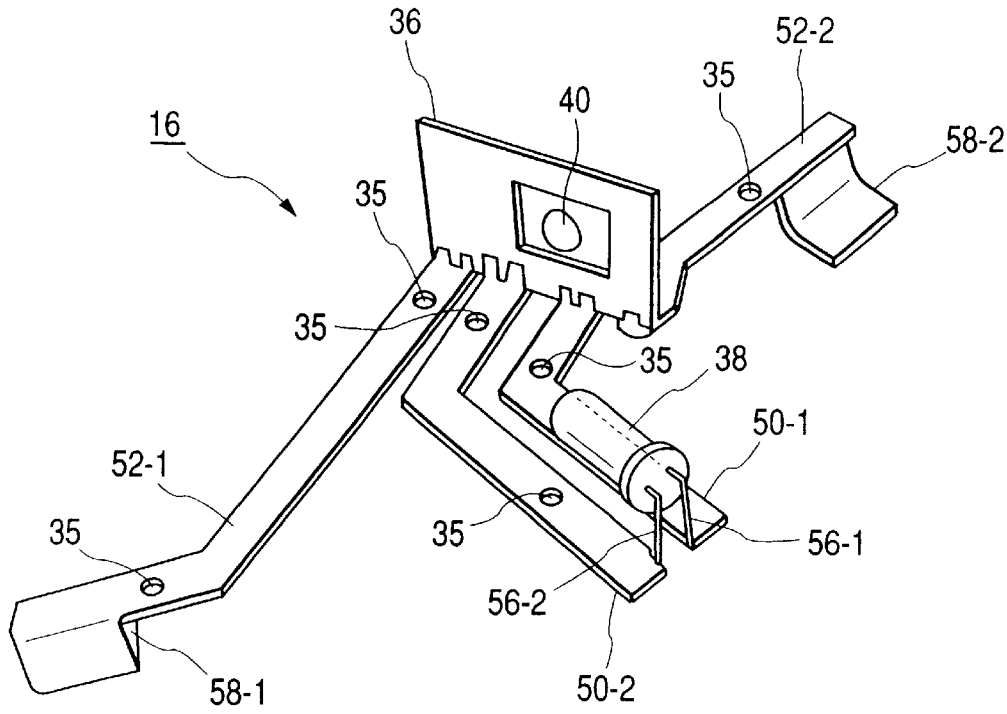
FIG. 4 is a descriptive view of a smoke detecting section shown in FIG. 2 when the smoke detecting section is taken out of the smoke detector and is viewed from a light receiving section.
Figure 5:
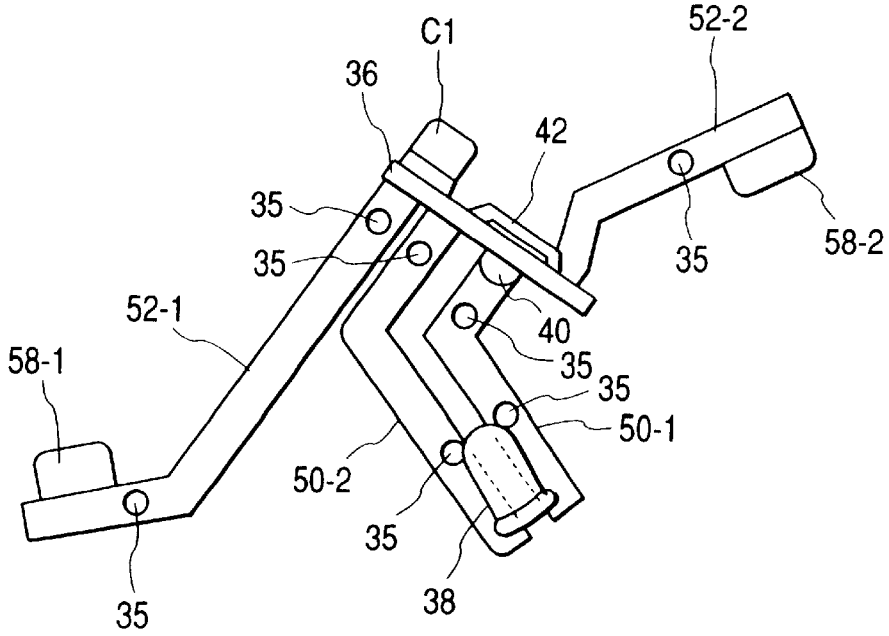
FIG. 5 is a plan view of the smoke detection section shown in FIG. 4.

FIG. 4 shows the smoke-detection-section assembly 16 shown in FIG. 2 when it is removed from the smoke detecting section 14. FIG. 5 is a plan view of the smoke-detection-section assembly 16. In the smoke-detection-section assembly 16, the pair of pieces of lead hardware (first lead hardware) 50-1 and 50-2 are fixed at one end to the edge of the hybrid circuit board 36. The light-emission element 38 is fixedly connected to the other ends of the pieces of lead hardware 50-1 and 50-2, by way of leads 56-1 and 56-2.

The light-emission element 38 is connected to and supported by the leads 56-1 and 56-2. As can be seen from a plan view shown in FIG. 5, the optical axis of the light-emission element 38 and the optical axis of the light-emission element incorporated in the integrated circuit 42 cross each other at a predetermined angle. Thus, the smoke detecting structure of scattered-light type is embodied. The leads 56-1 and 56-2 of the light-emission element 38 may be connected directly to the edge of the hybrid circuit board 36 in much the same way as the pieces of lead hardware 50-1 and 50-2, by means of forming and without use of the pieces of lead hardware 50-1 and 50-2.

A pair of pieces of lead hardware (second lead hardware) 52-1 and 52-2 are fixedly connected to the hybrid circuit board 36 such that one of the pieces of lead hardware is connected to one side of the circuit board 36 and the remaining piece of lead hardware is connected to the other side of the same. A rectangular base contact section 58-1 of bent structure is formed on the external end of the piece of lead hardware 52-1, and a rectangular base contact section 58-2 of bent structure is formed on the external end of the piece of lead hardware 52-2.

Further, one or a plurality of boss holes 35 are formed in each of the pieces of lead hardware 50-1, 50-2, 52-1, and 52-2. Bosses formed on the reverse side of the base 25 of the smoke detecting section main body 15 shown in FIG. 2 are fitted into corresponding bosses, thus fixedly positioning the smoke detecting section main body 15.

Figure 6A:
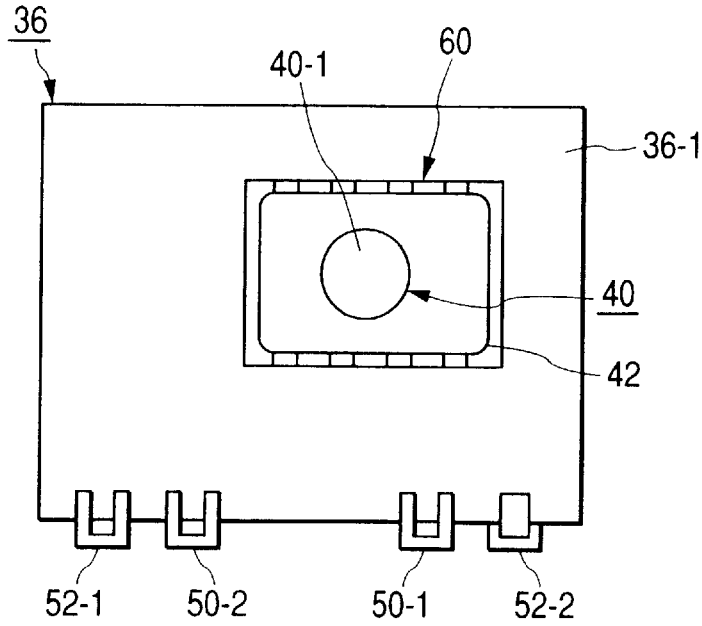
FIG. 6A is a descriptive view showing a light receiving section of the hybrid circuit board shown in FIG. 4.
Figure 6B:
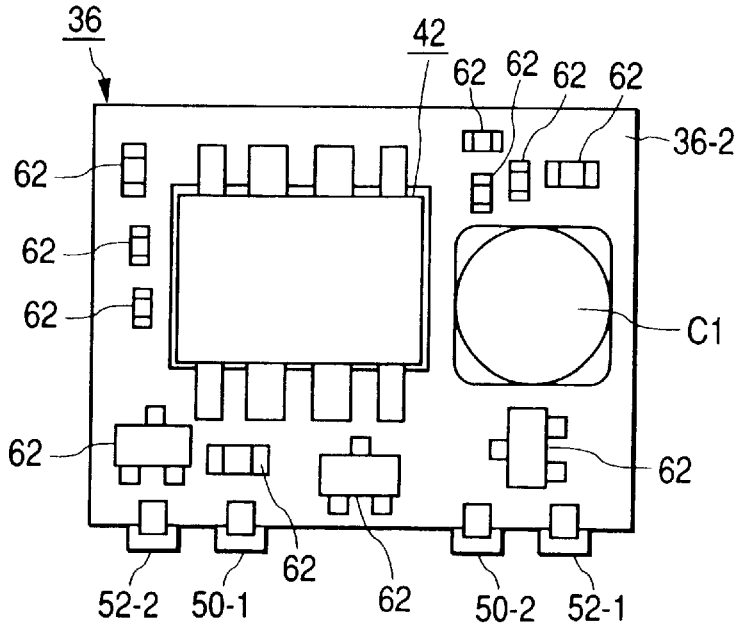
FIG. 6B is a descriptive view showing a circuit-component-mounted side of the hybrid circuit board shown in FIG. 4.

FIGS. 6A and 6B show the hybrid circuit board 36 shown in FIG. 4 when it is taken out from the smoke-detection-section assembly 16. FIG. 6A shows a light-receiving surface 36-1 positioned opposite the smoke detecting space, and an opening 60 is formed at a predetermined location on the hybrid circuit board 36. The light receiving section 40 is positioned in the opening 60.

FIG. 6B shows a part mount surface 36-2 which serves as the reverse side of the light-receiving surface 36-1. The integrated circuit 42 in which are packed a light-receiving element and the majority of sensor circuits is mounted on the part mount surface 36-2 while being turned upside down. Electric circuit components which are not included in the integrated circuit 42 are mounted around the integrated circuit 42 as surface-mounted discrete chip components 62. The surface-mounted capacitor C1 for supplying an electric current for causing the light-emitting element to emit light is mounted as an independent component, since the capacitor C1 is an electrolytic capacitor of large capacitance.

Figure 7A:
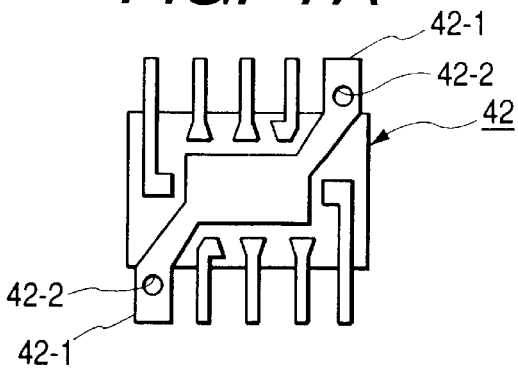
FIGS. 7A to 7C are cross-sectional views showing the hybrid circuit board shown in FIG. 6.

FIG. 7A shows the integrated circuit 42 when viewed from the underside thereof. A positioning hole 42-2 is formed in each of lead frames 42-1 located opposite in a diagonal direction of the integrated circuit 42. As shown in FIG. 6B, in a case where the lead frames 42-1 of the integrated circuit 42 are attached to component mount pads laid on the hybrid circuit board 36 by means of solder reflow, creamy solder is printed on the component mount pads. At this time, application of creamy solder to areas corresponding to the positioning holes 42-2 is avoided.

When the lead frames 42-1 of the integrated circuit 42 are subjected to solder reflow in this state, the positioning holes 42-2 are positioned in the areas on the component mount pads where no creamy solder is present, by means of surface tension of solder. As a result, the lens section 40-1 is positioned in the opening 60 shown in FIG. 6A.

Figure 7B:
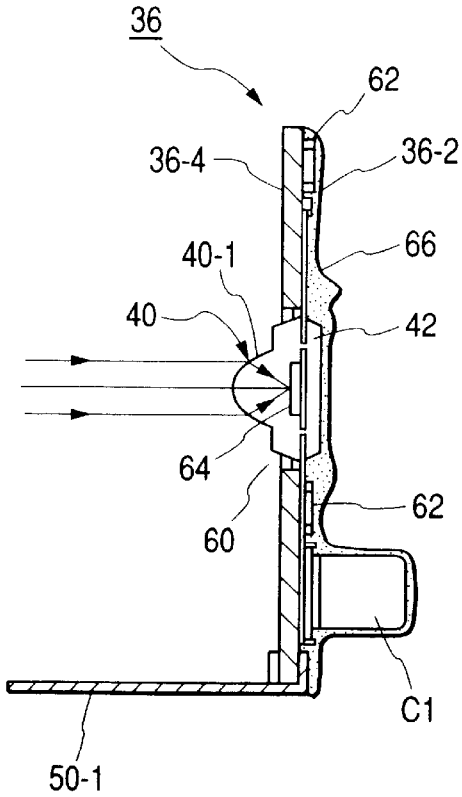

FIG. 7B is a cross-sectional view showing the hybrid circuit board 36. The integrated circuit 42 is mounted on the part mount surface 36-2 of the hybrid circuit 36 and in the center opening 60 while being turned upside down. A light-receiving element and circuitry including an amplifying circuit for the light-receiving element are integrated into an IC chip 64. The IC chip 64 is incorporated in the integrated circuit 42. The lens section 40-1 is integrally located in front of the light-receiving element of the IC chip 64, thereby constituting the light receiving section 40. The light-receiving element of the IC chip 64 is provided so as to be situated at the focal point of the lens section 40-1. The IC chip 64 is bonded to the ground portion of the lead frame provided in the integrated circuit 42 and is less susceptible to noise.

The integrated circuit 42, the capacitor C1, and the chip components 62 mounted on the part mount surface 36-2 of the hybrid circuit board 36 are wholly coated with a coating layer 66 such as epoxy resin, thus enhancing corrosion resistance of the hybrid circuit board 36. Such a structure of the hybrid circuit board 36 enables interconnection of the integrated circuit 42, the chip components 62 serving as discrete components, and the capacitor C, which remain mounted on the part mount surface 36-2, by means of solder reflow, without imparting influence to the light receiving section 40 of the integrated circuit 42. Further, only a single side of the hybrid circuit board 36; that is, the part mount surface 36-2, is subjected to dip coating, thus forming the coating layer 66. Thus, assembly of the hybrid circuit board 36 is easy, and costs of the hybrid circuit board 36 can be curtailed correspondingly.

Figure 7C:
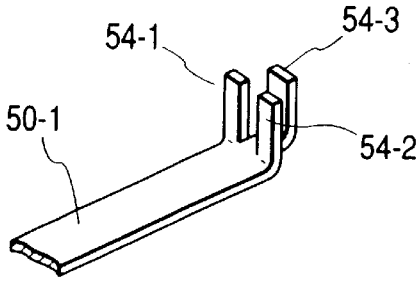

Taking the lead hardware 50-1 as an example, lead hardware to be fixedly connected to the hybrid circuit board 36 assumes a fitting structure such as that shown in FIG. 7C. A pair of lugs 54-1 and 54-2 are formed, by means of upwardly bending, at the end of the lead hardware 50-1 to be attached to the hybrid circuit board 36. A fitting lug 54-3 is formed, by means of bending, between and spaced apart from the lugs 54-1 and 54-2 by a distance corresponding to the thickness of the hybrid circuit board 36. As shown in FIG. 7B, the end face of the hybrid circuit board 36 is fitted into and fixedly connected to the space defined between the fitting lugs 54-1, 54-2 and the fitting lug 54-3, through soldering.

Figure 8:
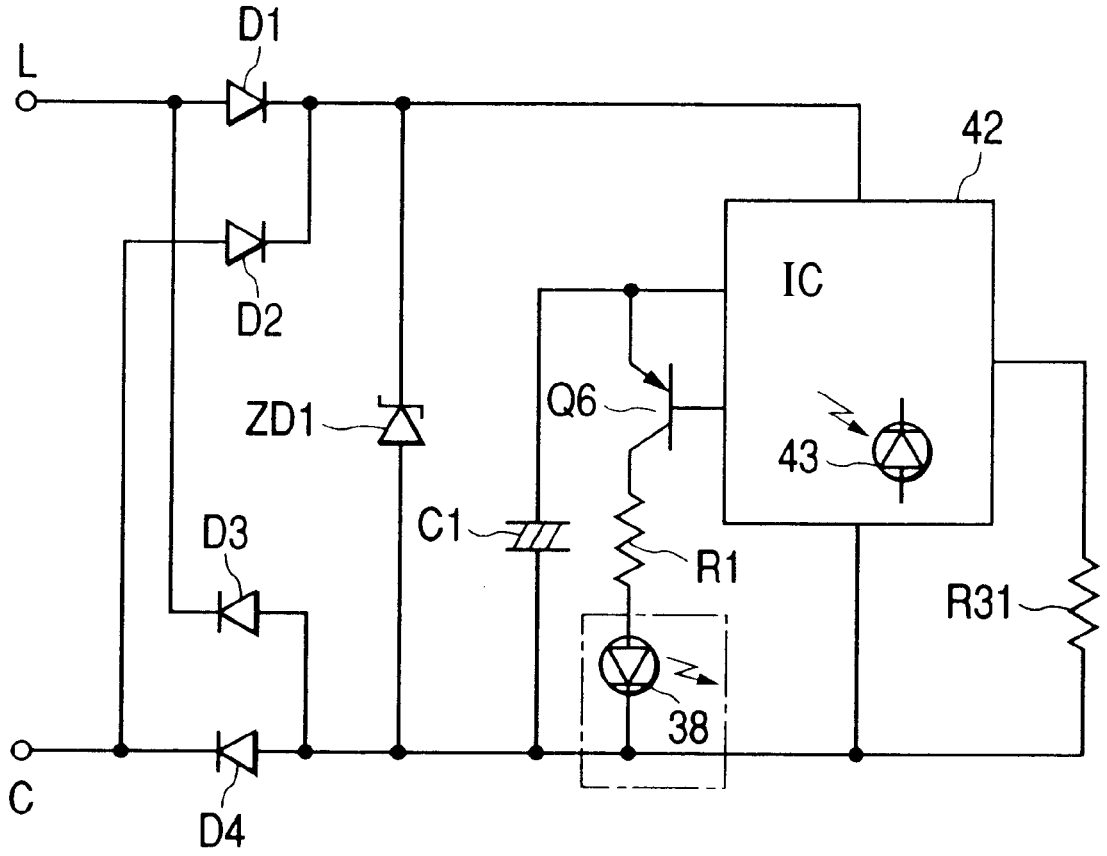
FIG. 8 is a circuit diagram showing a detector circuit mounted on the hybrid circuit board shown in FIG. 6.

FIG. 8 is a circuit diagram showing a sensor circuit mounted on the hybrid circuit board 36 according to the present invention.

As shown in FIG. 8, the only requirement is that, a total of ten parts; i.e., diodes D1 through D4; a Zener diode ZD1, the capacitor C1, a transistor Q6, resistors R1 and R36, and the integrated circuit 42, be mounted on the hybrid circuit board 36. The light-emission element 38 is connected to the hybrid circuit board 38 by way of the pieces of first lead hardware 50-1 and 50-2.

The diodes D1 to D4 constitute a diode bridge which serves as a rectifier circuit for terminals L and C. The Zener diode ZD1 serves as a noise absorption circuit. The capacitor C1 supplies electric current to the light-emission element 38 which is activated by an oscillator circuit provided in the integrated circuit 42. The resistor R1 sets the electric current flowing through the light-emission element 38. The transistor Q6 switches the light-emission element 38. The resistor R31 sets a reference voltage of a comparator circuit.

Figure 9:
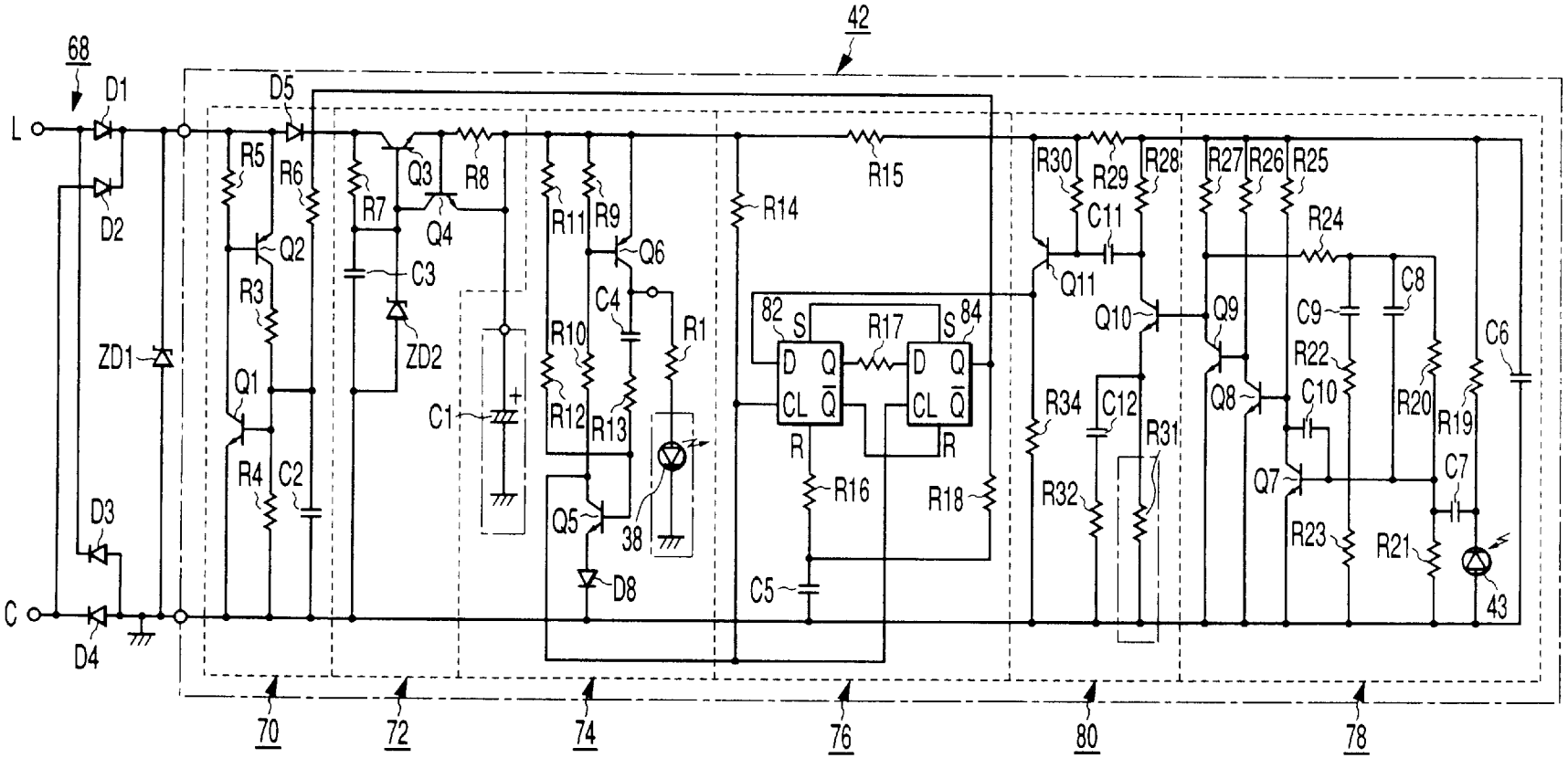
FIG. 9 is a circuit diagram showing details of the detector circuit shown in FIG. 8.

FIG. 9 is a circuit diagram showing details of the sensor circuit shown in FIG. 8. The sensor circuit according to the present invention is of conventional type and comprises a rectification/noise absorption circuit 68, a fire signal output circuit 70, a constant-voltage/current limit circuit 72, an oscillator circuit 74, a counter circuit 76, a comparator circuit 80, and an amplifying circuit 78.

Of these circuits, the rectification/noise absorption circuit 68, the capacitor C1 for supplying light-emission current to the oscillator circuit 74, the transistor Q6 for switching the light-emission element 38 which is activated by the oscillator circuit 74, a current limit resistor R1, and a resistor R31 for setting a reference voltage of the comparator circuit are constituted of electric parts serving as external circuits. Circuits other than these circuits are provided in the integrated circuits 42.

The sensor circuit will be described in more detail as follows: The sensor circuit has the terminals L and C connected to lead wires (sensor wires) which are to act as power/signal lines connected to a disaster-prevention monitor panel. The terminals L and C are followed by the rectification/noise absorption circuit 68, which has a diode bridge consisting of the diodes D1 to D4 and the Zener diode ZD1.

The rectification/noise absorption circuit 68 is followed by a self-holding-type fire signal output circuit 70. This self-holding-type fire signal output circuit 70 comprises transistors Q1 and Q2, resistors R4 through R6, a capacitor C2, and a diode D5. The transistors Q1 and Q2 are turned on by means of a signal output from the counter circuit 76, thereby causing a disaster warning current to flow to the terminals L and C. Eventually, a fire signal is sent to the disaster-prevention monitor panel.

The fire signal output circuit 70 is followed by the constant-voltage/current limit circuit 72 constituting a power circuit. A constant-voltage circuit is constituted of a transistor Q4, a resistor R7, a capacitor C3, and a Zener diode ZD2. Further, a current limit circuit is constituted of the transistor Q4 and a resistor R8.

The constant-voltage/current limit circuit 72 is followed by the oscillator circuit 74. The oscillator circuit 74 is constituted of transistors Q5 and Q6, resistors R9 to R13, a capacitor C4, and a diode D6. For instance, the transistor Q6 is switched at a cycle of, for example, two seconds, thereby causing a light-emission current to the light-emission element 38 to flow by way of the current limit resistor R1. The light-emission current flowing to the light-emission element 38 is supplied from the external capacitor C1 connected so as to follow the constant-voltage/current limit circuit 72.

The amplifying circuit 78 will now be described. The amplifying circuit 78 is provided with the light-receiving element 43 using an infrared photodiode. Scattered light is received by the light-receiving element 43 and is converted into a received-light current. The received-light current is amplified by the amplifying circuit 78 comprising transistors Q7 to Q9, resistors R20 to R27, and capacitors C6 to C9.

The amplifying circuit 78 is followed by the comparator circuit 80. The comparator circuit 80 is made up of transistors Q10 and Q11, resistors R28 through R34, and capacitors C11 and C12. When a signal output from the amplifying circuit 78 exceeds a predetermined threshold value, the transistors Q10 and Q11 are turned on, and an H-level received-light signal is output to the counter circuit 76 in synchronism with an oscillation pulse signal.

The counter circuit 76 is constituted of delayed flip-flop (D-FF) circuits 82 and 84, resistors R14 to R18, and a capacitor C5. When H-level signals are continuously output twice from the comparator circuit 80 in synchronism with a clock of an oscillator pulse signal output from the oscillator circuit 74, a signal Q output from a D-FF circuit 84 on an output stage is brought from a low level to a high level, thereby turning on the transistors Q1 and Q2 of the fire signal output circuit 70. The fire signal is sent to the disaster-prevention monitor panel.

The transistors Q1 and Q2 of the fire signal output circuit 70 constitute a latch circuit. As a result of the signal Q output from the D-FF circuit 84 on the output stage of the counter circuit 76 becoming high, output of the fire signal is maintained even when the D-FF circuits 82 and 84 are reset by a time constant defined by the capacitor C5 and the resistor R18, after lapse of a predetermined period of time. The smoke detecting circuit is constituted of the comparator circuit 80 and the counter 76.

The circuit configuration of the integrated circuit 42 shown in FIGS. 8 and 9 is a mere example. As a matter of course, the circuit configuration of the integrated circuit 42 may be changed, as required, so long as at least the light-receiving element 43 and the amplifying circuit 78 are integrated.

A plurality of integrated circuits may be formed by combination of a first integrated circuit comprising the light-receiving element 43 and the amplifying circuit 78 with a second integrated circuit comprising the remaining circuits.

Figure 10:
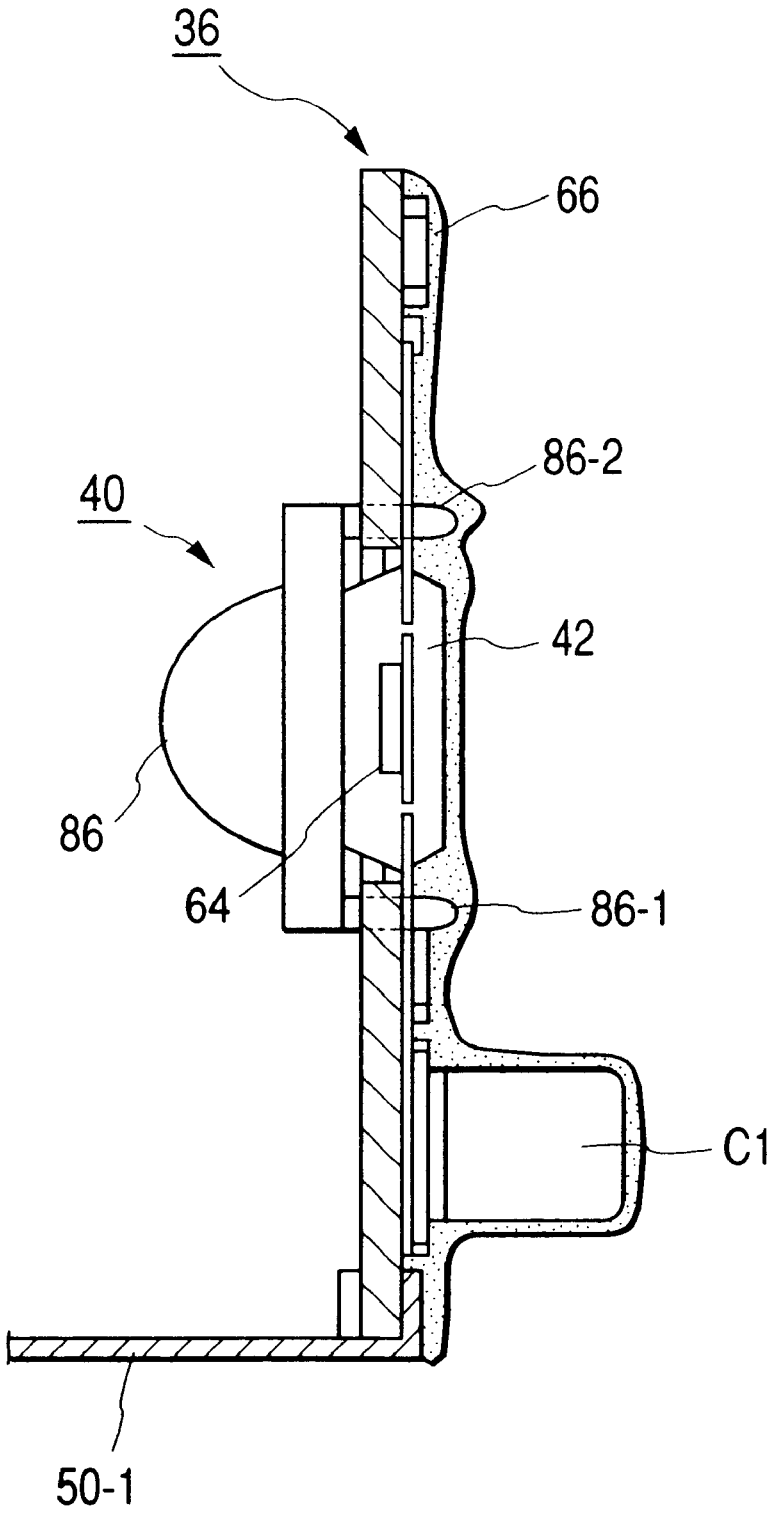
FIG. 10 is a cross-sectional descriptive view showing another embodiment of the hybrid circuit board, in which a lens unit is separated from a light receiving section.

FIG. 10 is a cross-sectional view showing another embodiment of the hybrid circuit board 36 used in the photoelectric smoke detector according to the present invention. FIG. 10 is a cross-sectional view of the hybrid circuit board 36 when the board 36 is assembled. In this embodiment, a lens unit 86 of the light receiving section 40 can be separated from the integrated circuit 42.

The integrated circuit 42 is fitted into the opening 60 of the hybrid circuit board 36 from the underside thereof. The hybrid circuit board 36 is subjected to solder reflow after the capacitor C1 and the chip components 62 have been mounted on the reverse side of the hybrid circuit board 36. The lens unit 86 is attached to the light-receiving side of the integrated circuit 42, and the coating layer 66 is formed over the reverse side of the hybrid circuit board 36, thereby fixing the capacitor c1 and the chip components 62.

Projections 86-1 and 86-2 provided on the lens unit 86 are fitted into insert holes formed at positions corresponding to the hybrid circuit board 36. In this state, the coating layer 66 is formed over the component mount surface 36-2, thereby bonding the projections 86-1 and 86-2 to the hybrid circuit board 36.

Thus, the lens unit 86 is separated from the integrated circuit 42. Therefore, in contrast with a case where the lens section 40-1 is integrally formed with the integrated circuit 42, as shown in FIG. 7B, a larger lens can be used. Further, a general-purpose package can be used without involvement of a new metal mold with a lens being formed for an integrated circuit.

FIG. 11 shows yet another embodiment of the hybrid circuit board 36 used in the photoelectric smoke detector according to the present invention. This hybrid circuit board 36 is characterized by addition of a light emission section.

As shown in FIG. 11, the light receiving section of the hybrid circuit board 36 is identical with that employed in the embodiment shown in FIG. 10. In other words, the lens unit 86 is separated from the light receiving section. In addition, a surface-mounted light-emission element 88 is mounted at a position below the lens unit 86. An optical member integrally consisting of a light guide 90 and a light-emission lens 92 is attached to the light-emission element 88.

The optical member consisting of the light guide 90 and the light-emission lens 92 can be readily made of transparent plastic material, such as transparent acrylic resin or the like. While the optical member is built into the smoke detecting section, a shield plate 94 is positioned between the lens unit 86 and the light-emission lens 92 of the light receiving section 40, thereby embodying a smoke detecting structure of scattered-light type.

Since the light emission section is fixedly supported by the hybrid circuit board 36, there is obviated a necessity for use of the pair of pieces of lead hardware 50-1 and 50-2 for fixedly supporting the light-emission element 38 in a smoke detecting space, as designated by the smoke-detection-section assembly 16 shown in FIGS. 4 and 5. The structure of the smoke-detection-section assembly 16 can be simplified correspondingly.

Figure 12:
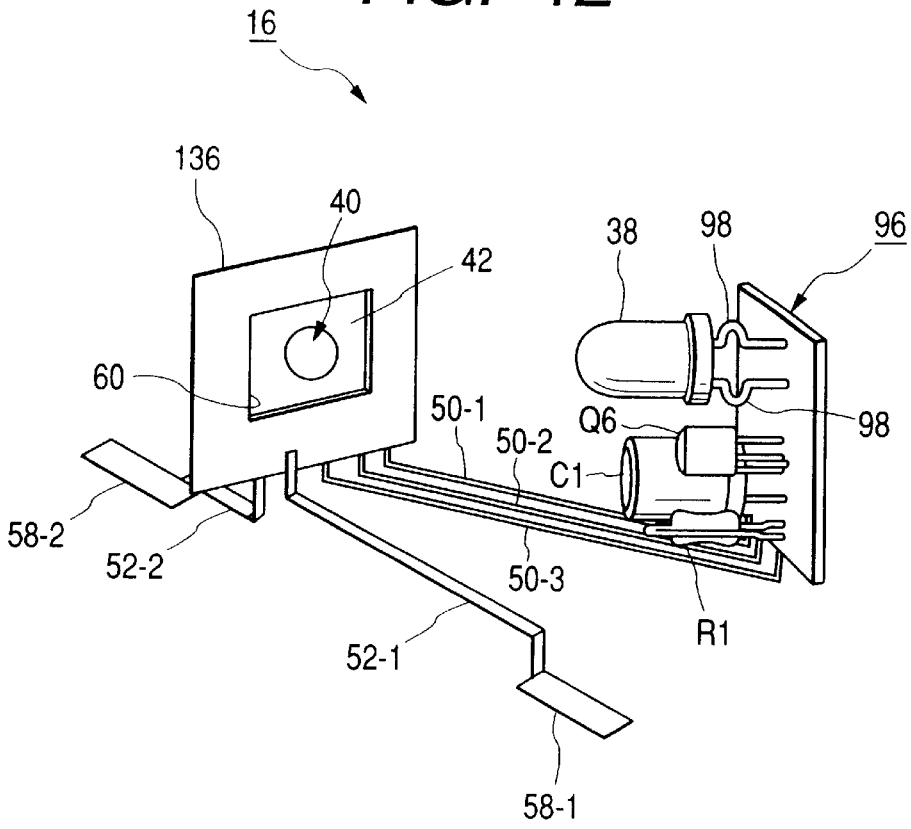
FIG. 12 is a descriptive view showing a smoke-detection-section assembly according to the present invention, in which a light emission section circuit board is separated from a light receiving section hybrid circuit board.

FIG. 12 shows another embodiment of the smoke-detection-section assembly 16 used in the photoelectric smoke detector according to the present invention. In this smoke-detection-section assembly 16, circuits of the light emission section to which a current of comparatively-large magnitude must flow is separated from the hybrid circuit board 36, and the thus-separated circuit is provided on a light-emission circuit board 96.

In the hybrid circuit board 36 according to the embodiment shown in FIG. 4, the transistor Q6, the current limit resistor R1, and the capacitor C1, which are included in the sensor circuit shown in FIG. 9 and into which a current of comparatively-large magnitude flows, are provided along with the light-receiving circuit which is susceptible to noise. Therefore, when a large light-emission current flows to the light-emission element, there is chance of noise being emitted from a pattern or a lead wire routed on a board, thus adversely affecting the light-receiving circuit.

For this reason, in the embodiment shown in FIG. 12, an electric component on the light-emission circuit section into which a current of comparatively-large magnitude flows is separated from a hybrid circuit 136 and provided on the light-emission circuit board 96 together with the light-emission element 38. The light-emission circuit board 96 is fixedly housed in the light emission section holder 32.

Figure 13:
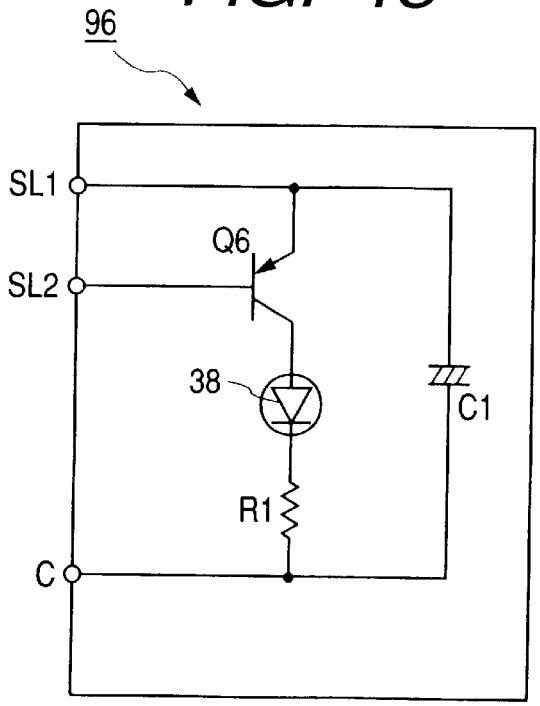
FIG. 13 is a circuit diagram showing the light-emission circuit board shown in FIG. 12.

FIG. 13 is a circuit diagram of the light-emission circuit board 96 shown in FIG. 12. The four components provided in the sensor circuit shown in FIG. 9; that is, the switching transistor Q6, the light-emission element 38, the current limit resistor R1, and the electrolytic capacitor C1, are mounted on the light-emission circuit board 96.

The resistance of the current limit resistor R1 is selected in accordance with the brightness of the light-emission element 38. More specifically, the brightness of the light-emission element 38 mounted on the light-emission circuit board 96 is determined by the current limit resistor R1. Therefore, a variable resistor may be used as the current limit resistor R1. Further, the circuit of the light-emission circuit board 96 is connected to the hybrid circuit board 136 by way of three terminals; that is, a terminal SL1, a terminal SL2, and a terminal C.

Turning again to FIG. 12, the three pieces of lead hardware 50-1, 50-2, and 50-3 are connected at one end and fixedly supported by the hybrid circuit board 136. The three pieces of hardware 50-1, 50-2, and 50-3 are fixedly connected and supported at the other end thereof to and at the light-emission circuit board 96 by way of the three terminals SL1, SL2, and C shown in FIG. 13. Further, the light-emission circuit board 96 is positioned such that the optical axis of the light-emission element 38 mounted on the light-emission circuit board 96 and the optical axis of the light receiving section 40 cross each other at a predetermined angle.

In order to facilitate positioning of the optical axis of the light-emission element 38, looped sections 98 are formed in lead sections of the light-emission element 38. By means of mechanically bending the looped sections 98 of the lead sections, easy adjustment of the optical axis of the light-emission element 38 is enabled. Thus, there can be set a correct cross angle with respect to the optical axis of the light receiving section 40. After the optical axis of the light emission section 38 has been determined, the leads of the light emission section 38 are potted through use of resin, thus protecting the light-emission element 38 from physical impact or vibration.

As a matter of course, as in the case of the circuit shown in FIG. 4, the lead hardware 52-1 having the base contact section 58-1 to be attached to a mount base and the lead hardware 52-2 having the base contact section 58-2 to be attached to a mount base are also connected to the hybrid circuit board 136.

The following advantage is yielded by the circuit configuration shown in FIG. 12, in which the light emission section through which a current of comparatively large magnitude flows is separated from the hybrid circuit board 136 and is provided as the light-emission circuit board 96.

Noise which is imposed on the amplifying circuit on the light-receiving circuit side as a result of light-emission driving operations is greatly diminished. Even in a case where the sensitivity of the light-emission element 38 cannot be adjusted fully at the time of manufacture of the smoke-detection-section assembly 16, there is no necessity of handling as defective the entire hybrid circuit board 36 such as that shown in FIG. 4. The only requirement is that the light-emission circuit board 96 be taken as defective. Therefore, an assembly yield can be improved correspondingly, or the present invention can readily cope with manufacture of products of greatly-different sensitivity.

Since the light-emission circuit board 96 is separated from the hybrid circuit board 136, the hybrid circuit board 136 of the light receiving section having the integrated circuit 42 mounted thereon can be made compact. The light-emission circuit board 96 has a size matching the size of a housing space originally formed in the light emission section holder. In contrast, the hybrid circuit board 136 provided on the light emission section side can be made compact. Therefore, the light receiving section holder can be made compact correspondingly, and the characteristic of smoke flowing into the smoke detecting space from the outside can be improved.

Figure 14:
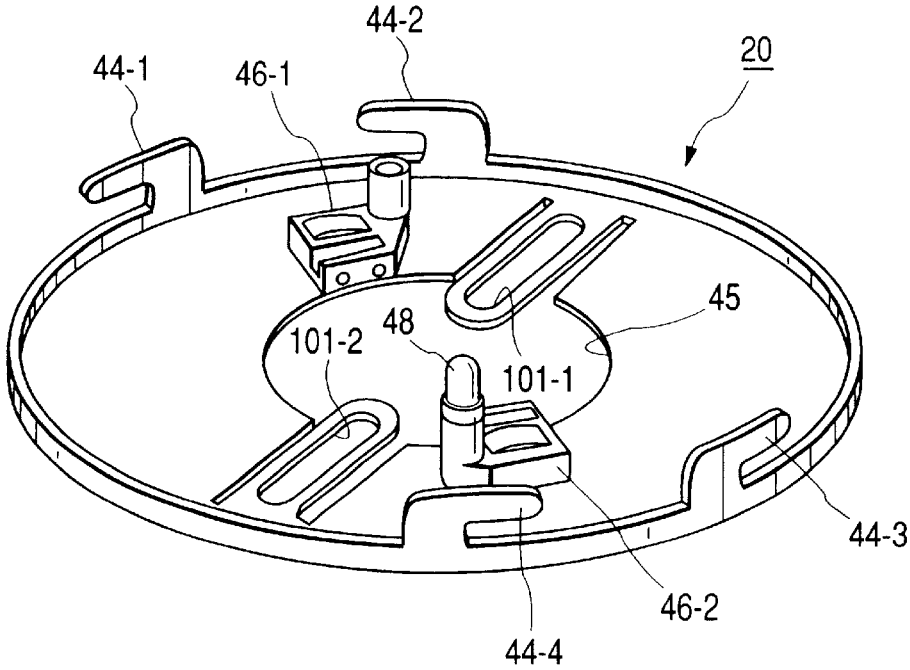
FIG. 14 is a descriptive view showing a thin mount base used in the present invention.

FIG. 14 shows the mount base 20 to be used in mounting the photoelectric smoke detector 10 on the ceiling. As has been described in connection with the exploded view shown in FIG. 2, the mount base 20 corresponds to a thin disk-shaped member formed from a metal plate. The four fitting pieces 44-1 through 44-4 are formed at respective positions so as to project toward surroundings, and the wire through-hole 45 is formed in the center of the mount base 20. Further, the pair of mount screw through holes 101-1 and 101-2 are formed along the wire through hole 45 so as to become opposite each other.

While the mount base 20 is attached to the ceiling, the terminal blocks 46-1 and 46-2 are secured on the down-facing surface of the mount base 20. Further, the disaster warning indication lamp 48 is fitted to the terminal block 46-2.

Figure 15A:
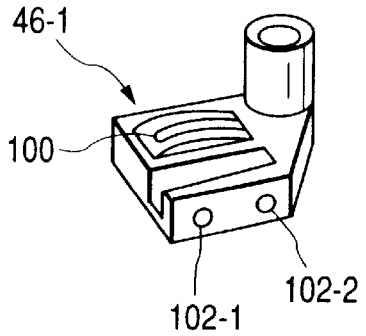
FIGS. 15A and 15B are descriptive views showing a terminal unit attached to the mount base shown in FIG. 14.
Figure 15B:
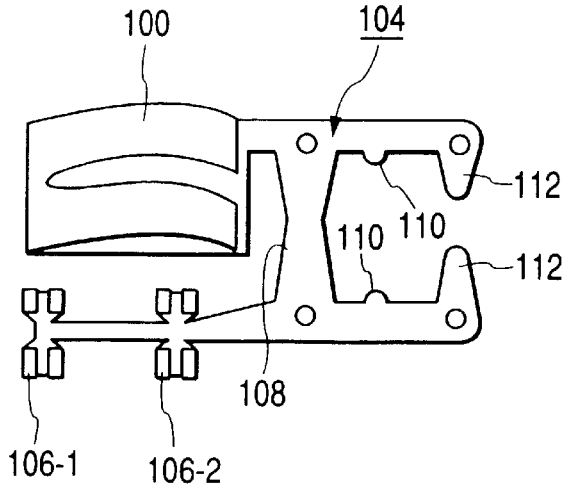

FIGS. 15A and 15B show the terminal block 46-1 shown in FIG. 14. As shown in FIG. 15A, the detector contact section 100 is provided on the surface of a substantially-rectangular block member. A pair of lead wire insert holes 102-1 and 102-2 are formed in the side surface of the detector contact section 100.

Terminal hardware 104 having a structure such as that shown in FIG. 15B is fitted into the terminal block 46-1 molded of insulating synthetic resin. The terminal hardware 104 has the detector contact section 100 and lead wire contact sections 106-1 and 106-2 located in the lead wire insert holes 102-1 and 102-2.

The terminal hardware 104 has a connection section 108 for interconnecting the detector contact section 100 and the lead wire contact sections 106-1 and 106-2. On the side of the connection section 108 opposite to the detector contact section 100, there are formed a resistor connection section 110 and a disaster warning indication lamp connection section 112 such that the resistor connection section 110 is formed from two separated portions and such that the disaster warning indication lamp connection section 112 is formed from two separated portions.

Figure 16A:
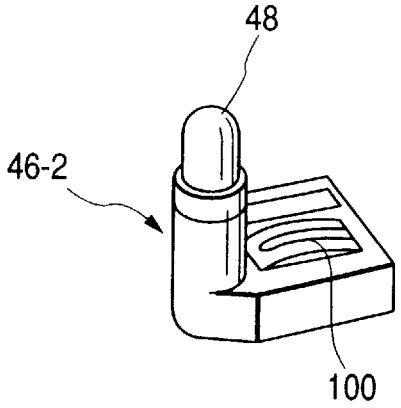
FIGS. 16A and 16B are descriptive views showing a terminal unit with a disaster warning indicating lamp, the unit being attached to the mount base shown in FIG. 14.
Figure 16B:
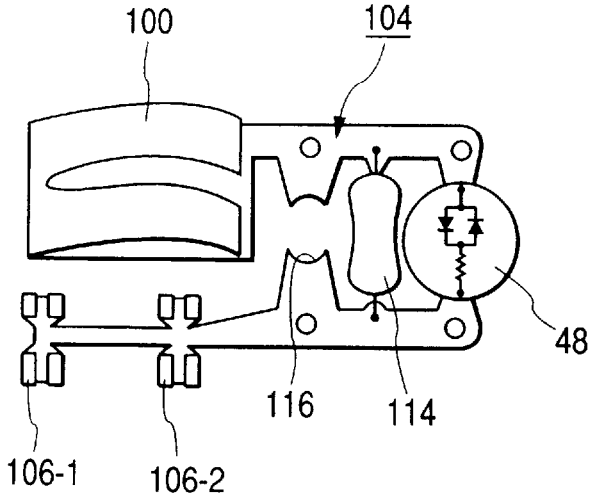

FIGS. 16A and 16B show the terminal block 46-2 shown in FIG. 14, wherein the disaster warning indication lamp 48 is attached to the terminal block 46-2. As in the case of the terminal block 46-1 shown in FIG. 15, the terminal block 46-2 is provided with the detector contact section 100. Further, the pair of lead wire insert holes 102-1 and 102-2 are formed in the side surface of the terminal block 46-2 facing the terminal block 46-1, as in the case of the terminal block 46-1 shown in FIGS. 15A and 15B.

FIG. 16B shows the terminal hardware 104 to be fitted into the terminal block 46-2. As in the case of the terminal block 104 shown in FIG. 15B, the terminal hardware 104 has the detector contact section 100 and the pair of lead wire contact sections 106-1 and 106-2. In addition, a resistor 114 and the disaster warning indicating lamp 48 of non-polarity are connected to the terminal block 104. The connection section 108 shown in FIG. 14B is cut by means of punching or a like method, thus forming a disconnection section 116.

As mentioned above, each of the terminal blocks 46-1 and 46-2 to be mounted on the mount base 20 employ the same terminal hardware 104 basically. If the terminal hardware 104 is provided with the resistor 114 and the disaster warning indicating lamp 48 and the connection section 108 is separated, there can be obtained the terminal block 46-2 having the disaster warning indicating lamp 48 such as that shown in FIG. 16A.

Figure 17:
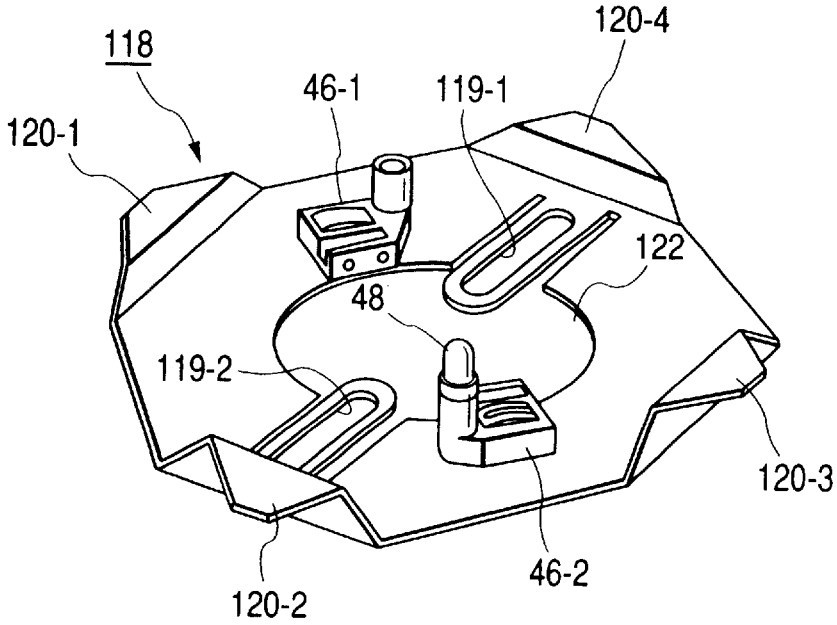
FIG. 17 is a descriptive view showing a polygonal mount base used in the present invention.
Figure 18:
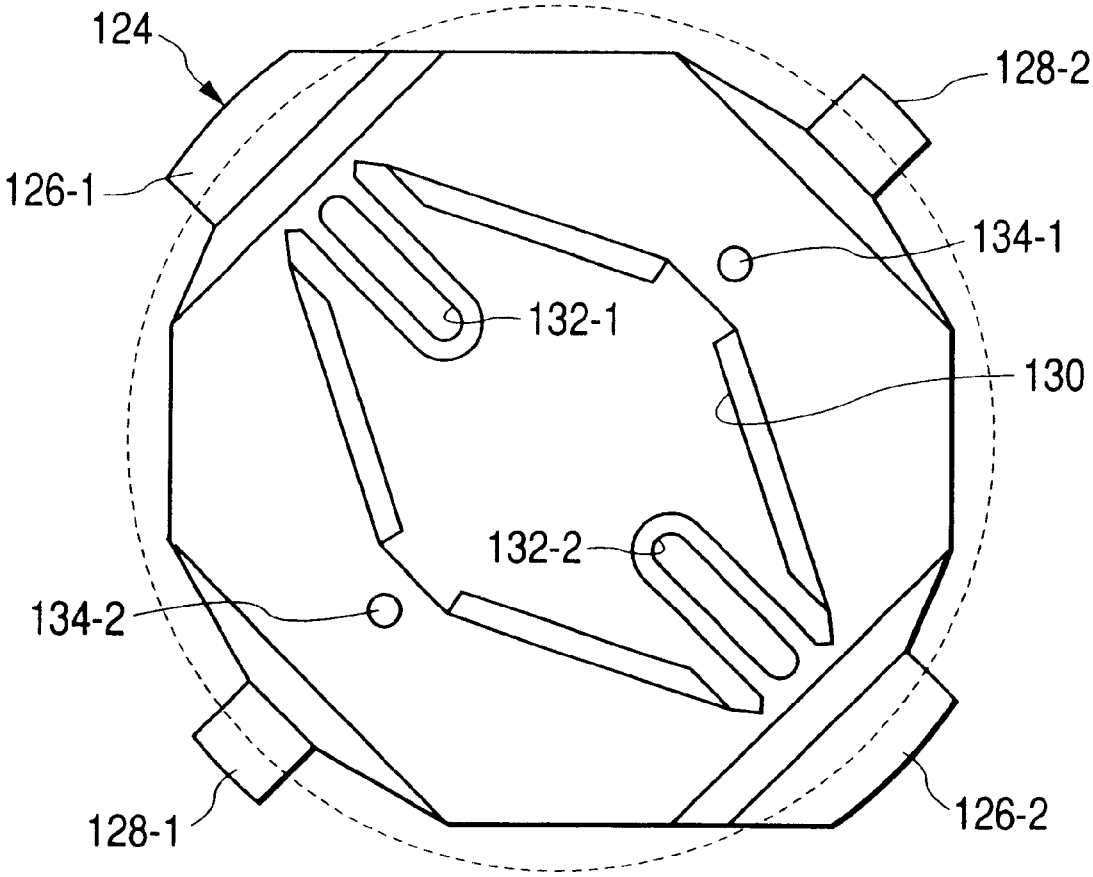
FIG. 18 is a descriptive view showing another embodiment of a polygonal mount base used in the present invention.
Figure 19:
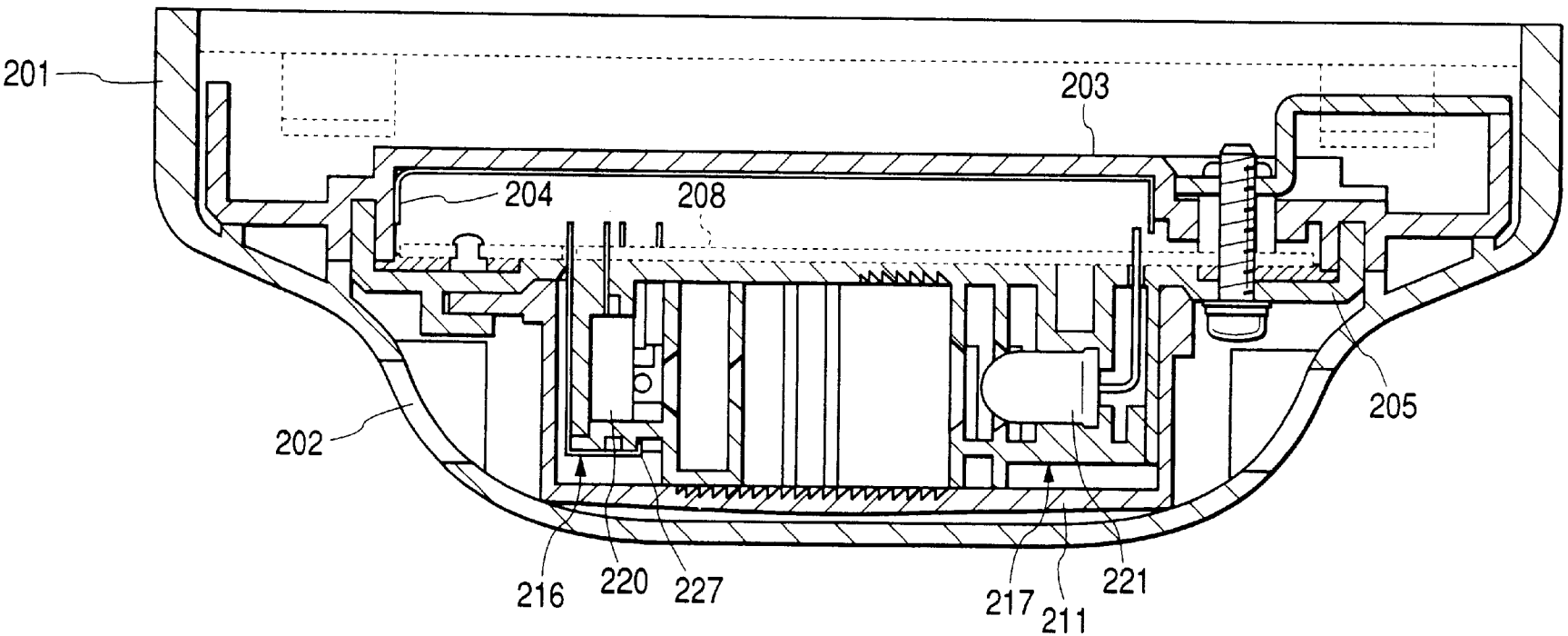
FIG. 19 is a cross-sectional view showing a commonly-employed photoelectric smoke detector.
Figure 20:
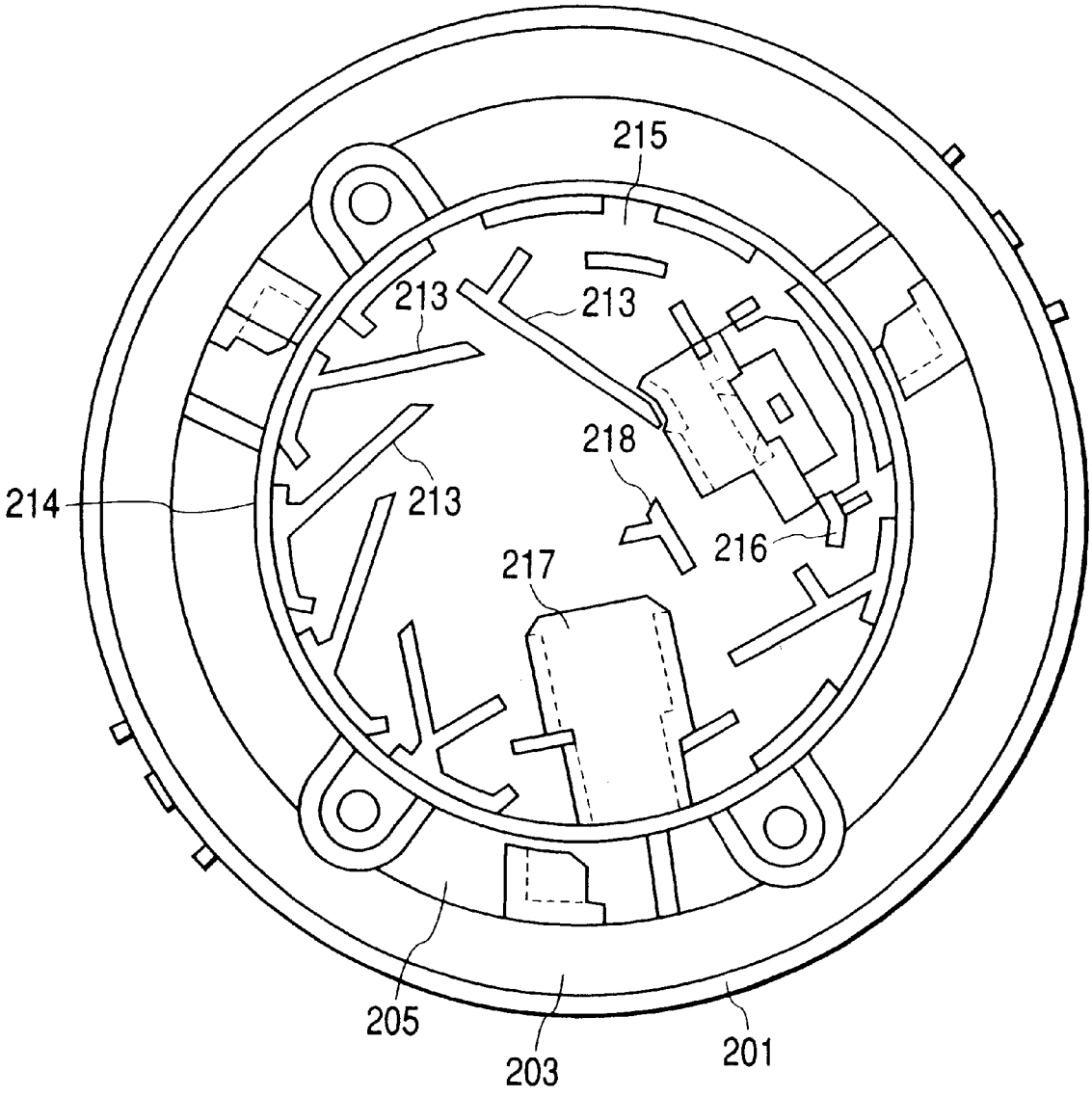
FIG. 20 is a plan view showing the internal structure of the photoelectric smoke detector shown in FIG. 19.
Figure 21:
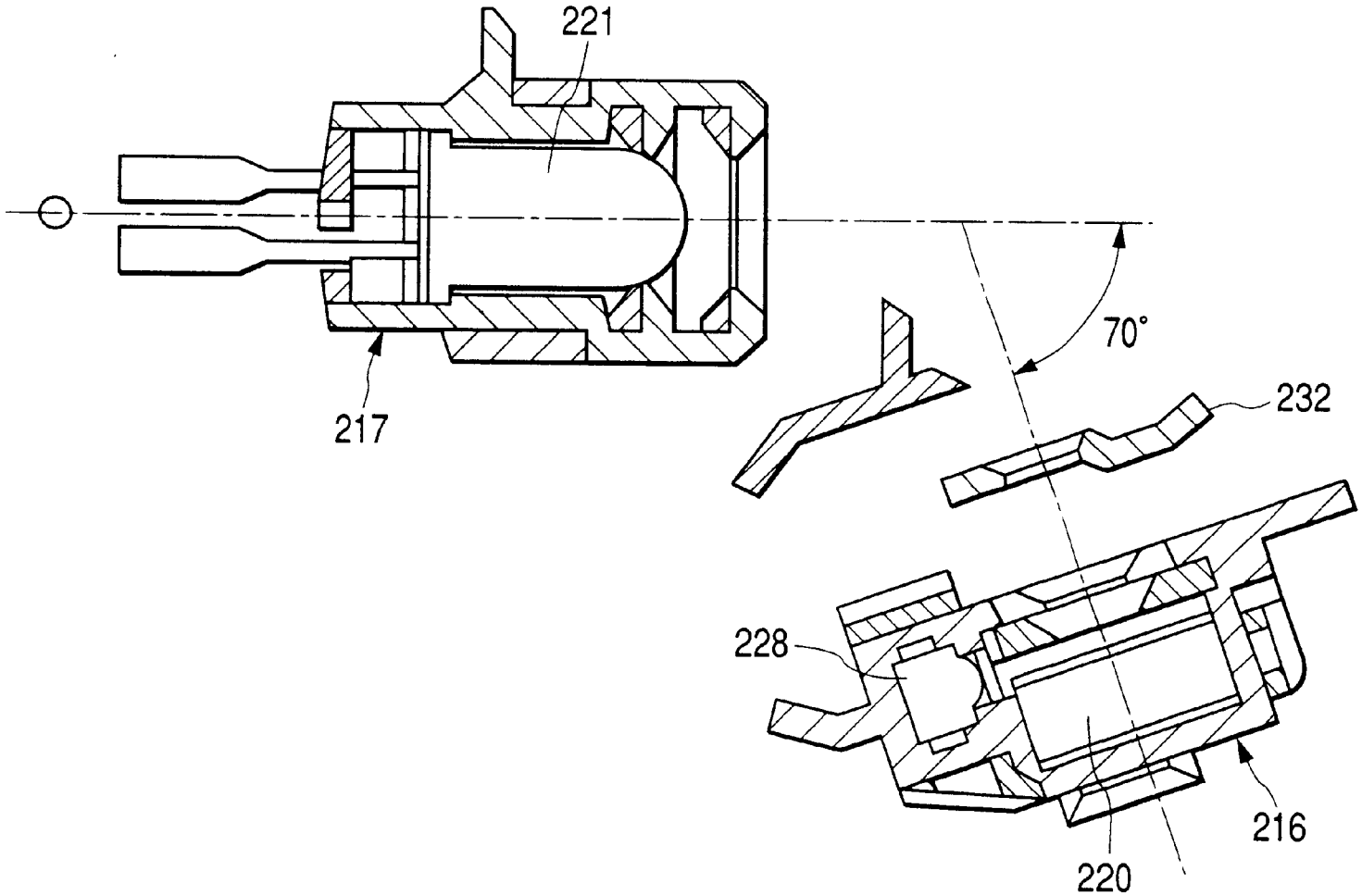
FIG. 21 is an illustration for describing the layout of a light emission section and a light receiving section of the photoelectric smoke detector of scattered-light type.

FIG. 18 shows another embodiment of the mount base 20 to be used with the photoelectric smoke detector according to the present invention. As shown in FIG. 17, the mount base is embodied as a polygonal mount base 118 in the present embodiment. Corners of a rectangular plate are bent,to thereby form fitting pieces 120-1 to 120-4.

In contrast with the mount base 20 shown in FIG. 14 in which fitting pieces are formed so as to project upward, sheet-metal working of a mount base becomes more facilitated. The mount base 118 has a wire through hole 112, mount screw through holes 119-1 and 119-2, and the pair of terminal blocks 46-1 and 46-2, as does the mount base 20.

FIG. 18 is a developed view of a polygonal mount base according to still another embodiment of the present invention. In the case of a polygonal mount base 124, after a metal plate has been formed into a polygonal shape matching the circular shape of the photoelectric smoke detector, fitting pieces 126-1 and 126-2 and fitting pieces 128-1 and 128-2, which differ in shape with each other, are spaced apart 90° apart from one another along the periphery of the polygonal mount base 124. These fitting pieces enable a rotational fitting operation through only an angle of 180°.

A wire through hole 130 formed in the center of the polygonal mount base 124 assumes a substantially rhomboid shape. End faces of the wire through hole 130 are bent, to thereby enhance the strength of the wire through hole 130. A pair of mount screw through holes 132-1 and 132-2 are provided on respectively mutually-opposing corners so as to mutually oppose along the longitudinal axis of the rhomboid. Mount holes 134-1 and 134-2 used for mounting the terminal blocks 46-1 and 46-2 are formed in respective positions so as to cross the longitudinal line at right angles.

As a matter of course, the mount base used for a photoelectric smoke detector according to the present invention is not limited to the foregoing embodiments. So long as fitting pieces are provided along the periphery of a mount base and a wire through hole and mount screw through holes are formed in the mount base, the mount base can be formed from a thin metal plate by means of sheet-metal working.

The foregoing embodiments have described a photoelectric smoke detector as an example. However, the present invention can also be applied to another smoke detector, such as an ion-type smoke detector. Further, the present invention is not limited to the above-described embodiments and may be subjected to modifications, as required, without impairing the objective and advantages of the present invention. Further, the present invention is not limited by numerical values provided in the respective embodiments.

As has been described above, the smoke detector according to the present invention comprises an insect screen which is formed from soft material of mesh structure and is arranged so as to cover the entirety of the smoke detecting section. As a result, there can be embodied a low-cost insect screen structure easy to assemble.

In contrast with a commonly-employed insect screen made by means of etching a metal plate, the fabric insect screen has a higher airflow permeability. In a case where an repellent is applied to an insect screen, since the insect screen is made of fabric, the fiber is sufficiently impregnated with an repellent, thus exhibiting an insect-proofing effect over a long period of time.

The insect screen is fixedly sandwiched between the interior circumferential edge of the exterior cover and the exterior circumferential edge of the smoke detecting main body and does not have any special fixing structure. Hence, the insect screen can be readily removed by means of removal of only the exterior cover.

What is claimed is:

1. A smoke detector which includes a smoke detecting section defining a smoke detecting space and detects occurrence of fire by detection of smoke flowing into the smoke detection space, the smoke detector comprising:

an insect screen which is formed from a soft material of mesh structure and is arranged around the smoke detecting section, wherein the insect screen is impregnated with an insect repellant.

2. The smoke detector as defined in claim 1, wherein the smoke detecting section is open toward the periphery and the bottom, and the insect screen is arranged so as to fully cover the periphery of the smoke detecting section and the open bottom of the smoke detecting section.

3. The smoke detector as defined in claim 1, wherein the insect screen is made from a woven permeable fabric.

4. The smoke detector as defined in claim 1, wherein the insect screen is fixedly sandwiched between an interior circumferential edge of an exterior cover and an exterior circumferential edge of a smoke detecting main body.

5. The smoke detector as defined in claim 3, wherein the insect screen is made from permeable fabric woven from soft metal fiber.

6. The smoke detector as defined in claim 3, wherein the insect screen is made from permeable fabric woven from chemical fiber.

7. The smoke detector as defined in claim 3, wherein the insect screen is made of tulle that is woven into a hexagonal mesh pattern from a plurality of strings of chemical fiber yarn.

8. The smoke detector as claimed in claim 3, wherein the insect screen is made of organdie, which is fabric woven made of hexagonally woven a plurality of fabrics.

9. The smoke detector as claimed in claim 3, wherein the insect screen has a uniform mesh pattern.

10. The smoke detector as claimed in claim 9, wherein the uniform mesh pattern is hexagonal.

11. The smoke detector as claimed in claim 9, wherein the insect screen has 20 to 50 meshes per inch.

12. An insect screen for preventing intrusion of insects into a smoke detecting space of a smoke detector, in which the insect screen is made of permeable fabric woven from metal or chemical fiber, wherein the insect screen is impregnated with an insect repellant.

* * * * *